US007006781B2

(12) United States Patent
Imai et al.

(10) Patent No.: US 7,006,781 B2
(45) Date of Patent: Feb. 28, 2006

(54) HEATING ROLLER, HEATING BELT, IMAGE HEATING DEVICE, AND IMAGE FORMING DEVICE

(75) Inventors: Masaru Imai, Hirakata (JP); Masakazu Mizusaki, Fukuoka (JP); Masaaki Nakano, Shijonawate (JP); Syuuiti Watanabe, Yawata (JP); Keisuke Fujimoto, Hirakata (JP); Masaomi Inoue, Onojo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/469,267

(22) PCT Filed: Nov. 8, 2002

(86) PCT No.: PCT/JP02/11636

§ 371 (c)(1),
(2), (4) Date: Aug. 28, 2003

(87) PCT Pub. No.: WO03/043379

PCT Pub. Date: May 22, 2003

(65) Prior Publication Data

US 2004/0105708 A1 Jun. 3, 2004

(30) Foreign Application Priority Data

Nov. 14, 2001 (JP) ..... 2001-349189

(51) Int. Cl.
*G03G 15/20* (2006.01)

(52) U.S. Cl. ..... 399/333; 219/216; 219/619; 219/634; 399/330

(58) Field of Classification Search ..... 219/216, 219/469, 619, 634, 635; 492/46, 53, 54; 399/320, 328, 329, 330, 333, 335
See application file for complete search history.

(56) References Cited

U.S. PATENT DOCUMENTS

| | | | |
|---|---|---|---|
| 4,948,466 | A | 8/1990 | Jaakkola |
| 5,768,673 | A | 6/1998 | Morigami et al. |
| 5,832,354 | A | 11/1998 | Kouno et al. |

(Continued)

FOREIGN PATENT DOCUMENTS

| | | |
|---|---|---|
| EP | 0 957 412 | 11/1999 |

(Continued)

*Primary Examiner*—Hoang Ngo
(74) *Attorney, Agent, or Firm*—Hamre, Schumann, Mueller & Larson, P.C.

(57) ABSTRACT

A heating roller (21) includes a heat generating layer (22) that generates heat by electromagnetic induction, a heat insulating layer (23), and a supporting layer (24), which are provided inwardly in this order. The heat generating layer (22) is composed of at least two layers that are a first heat generating layer of a magnetic material and a second heat generating layer of a non-magnetic material. The first heat generating layer has a specific resistance higher than a specific resistance of the second heat generating layer and a thickness larger than a thickness of the second heat generating layer. This allows the second heat generating layer to function effectively as a heat generating part that generates heat by electromagnetic induction. Thus, compared with the case where the heat generating layer (22) is formed only of a single layer of a magnetic material, heat generation efficiency is increased, thereby allowing warm-up time to be reduced. Further, the heat generating layer (22) is heated intensively, so that heat generation of the supporting layer (24) is reduced, thereby allowing the prevention of breakage of, for example, bearings supporting the heating roller (21).

17 Claims, 15 Drawing Sheets

U.S. PATENT DOCUMENTS

| | | | | |
|---|---|---|---|---|
| 5,862,445 | A | 1/1999 | Ogawa et al. | |
| 5,915,147 | A | 6/1999 | Kouno et al. | |
| 5,939,337 | A | 8/1999 | Hatakeyama et al. | |
| 6,021,303 | A | 2/2000 | Terada et al. | |
| 6,037,576 | A | 3/2000 | Okabayashi et al. | |
| 6,069,347 | A | 5/2000 | Genji et al. | |
| 6,175,713 | B1 | 1/2001 | Uehara et al. | |
| 6,453,144 | B1 | 9/2002 | Sato | |
| 6,605,802 | B1 * | 8/2003 | Nagahira | 219/619 |
| 6,668,151 | B1 | 12/2003 | Uehara et al. | |
| 6,687,481 | B1 | 2/2004 | Watanabe et al. | |
| 6,810,230 | B1 | 10/2004 | Imai et al. | |

FOREIGN PATENT DOCUMENTS

| | | |
|---|---|---|
| EP | 1 174 774 | 1/2002 |
| JP | 08-16007 | 1/1996 |
| JP | 9-44015 | 2/1997 |
| JP | 9-80939 | 3/1997 |
| JP | 9-127810 | 5/1997 |
| JP | 10-48976 | 2/1998 |
| JP | 10-74007 | 3/1998 |
| JP | 10-74009 | 3/1998 |
| JP | 10-254263 | 9/1998 |
| JP | 10-319751 | 12/1998 |
| JP | 11-288190 | 10/1999 |
| JP | 2001-206814 | 7/2000 |
| JP | 2001-5315 | 1/2001 |
| JP | 2001-230064 | 8/2001 |
| JP | 2002-93566 | 3/2002 |

* cited by examiner

HEATING ROLLER, HEATING BELT, IMAGE HEATING DEVICE, AND IMAGE FORMING DEVICE

TECHNICAL FIELD

The present invention relates to a heating roller and a heating belt that are heated by an eddy current generated utilizing electromagnetic induction. Furthermore, the present invention relates to an image heating device that is used suitably as a fixing device for thermally fixing an unfixed image by heating in an image forming apparatus such as an electrophotographic apparatus and an electrostatic recording apparatus or the like. Moreover, the present invention relates to an image forming apparatus including such an image heating device.

BACKGROUND ART

Conventionally, as image heating devices typified by thermofixing devices, contact heating type devices such as of a roller heating type and a belt heating type have been in general use.

In recent years, in response to the demand for a reduction in power consumption and warm-up time, roller heating type and belt heating type devices employing an electromagnetic induction heating method have been proposed.

FIG. 20 shows an example of a conventional image heating device including a heating roller that is heated by electromagnetic induction (see, for example, JP11(1999)-288190 A).

In FIG. 20, reference numeral 820 denotes a heating roller including a supporting layer 824 made of metal, an elastic layer 823 that is formed from a heat-resistant foam rubber and molded integrally on an outer surface of the supporting layer 824, a heat generating layer 821 formed of a metallic tube, and a mold releasing layer 822 provided on an outer surface of the heat generating layer 821, which are provided outwardly in this order. Reference numeral 827 denotes a pressing roller that is formed from a heat-resistant resin and has the shape of a hollow cylinder. A ferrite core 826 wound with an excitation coil 825 is placed in an inner portion of the pressing roller 827. The ferrite core 826 applies pressure to the heating roller 820 through the pressing roller 827, and thus a nip part 829 is formed. While the heating roller 820 and the pressing roller 827 rotate in the respective directions indicated by arrows, a high-frequency current is fed through the excitation coil 825. This causes alternating magnetic fields H to be generated, so that the heat generating layer 821 of the heating roller 820 is heated rapidly by electromagnetic induction to a predetermined temperature. While predetermined heating is continued in this state, a recording material 840 is inserted into and passed through the nip part 829. Thus, toner images 842 formed on the recording material 840 are fixed on the recording material 840.

Furthermore, in addition to devices of the above-mentioned roller heating type using the heating roller 820 having the induction heat generating layer 821 as shown in FIG. 20, devices of the belt heating type using an endless belt including an induction heat generating layer have been proposed. FIG. 21 shows an example of a conventional image heating device using an endless heating belt that is heated by electromagnetic induction (see, for example, JP10(1998)-74007 A).

In FIG. 21, reference numeral 960 denotes a coil assembly as an excitation unit that generates a high-frequency magnetic field. Reference numeral 910 denotes a metal sleeve (heating belt) that generates heat under a high-frequency magnetic field generated by the coil assembly 960. The metal sleeve 910 is formed by coating a surface of an endless tube made from a thin layer of nickel or stainless with a fluorocarbon resin. An inner pressing roller 920 is inserted in an inner portion of the metal sleeve 910, and an outer pressing roller 930 is placed outside the metal sleeve 910. The outer pressing roller 930 is pressed against the inner pressing roller 920 such that the metal sleeve 910 is interposed between them, and thus a nip part 950 is formed. While the metal sleeve 910, the inner pressing roller 920, and the outer pressing roller 930 rotate in the respective directions indicated by arrows, a high-frequency current is fed through the coil assembly 960. Thus, the metal sleeve 910 is heated rapidly by electromagnetic induction to a predetermined temperature. While predetermined heating is continued in this state, a recording material 940 is inserted into and passed through the nip part 950. Thus, a toner image formed on the recording material 940 is fixed on the recording material 940.

In each of the image heating devices employing the electromagnetic induction heating method, which are shown in FIGS. 20 and 21, a further reduction in warm-up time requires a reduction in thermal capacity of the heat generating layer heated by induction heating, i.e. a reduction in thickness of the heat generating layer.

However, in the image heating device of the roller heating type shown in FIG. 20, in order to obtain a desired thermal capacity by reducing a thickness of the heat generating layer 821 while using an electric current at the same frequency as an electric current to be applied to the excitation coil 825, it is required that the thickness be reduced so as to be smaller than a skin depth, i.e. a thickness defined by a flow of an induction current. With such a reduction in thickness, magnetic flux (leakage magnetic flux) that penetrates the heat generating layer 821 so as to leak therefrom is increased, so that in the supporting layer 824, an eddy current is generated to cause the supporting layer 824 to be heated. As a result, for example, bearings supporting the supporting layer 824 are heated, and thus deterioration and breakage are caused in the bearings, and the rate of power contributing to heat generation of the heat generating layer 821 is decreased, thereby undesirably causing an increase in warm-up time, which have been disadvantageous.

Similarly, in the image heating device of the belt heating type shown in FIG. 21, in order to obtain a desired thermal capacity by reducing a thickness of a heat generating layer of the metal sleeve 910 while using an electric current at the same frequency as an electric current to be applied to the coil assembly 960, it is required that the thickness be reduced so as to be smaller than a skin depth, i.e. a thickness defined by a flow of an induction current. With such a reduction in thickness, magnetic flux that penetrates the heat generating layer to leak therefrom reaches the inner pressing roller 920, so that in the inner pressing roller 920, an eddy current is generated to cause the inner pressing roller 920 to be heated. As a result, for example, bearings supporting the inner pressing roller 920 are heated, and thus deterioration and breakage are caused in the bearings, and the rate of power contributing to heat generation of the heat generating layer is decreased, thereby undesirably causing an increase in warm-up time, which have been disadvantageous.

In order to prevent these problems, the skin depth should be reduced so as to be smaller than a thickness of the heat generating layer. However, in order to reduce the skin depth, it is required that an electric current at a higher frequency be applied, thereby resulting in problems such as an increase in cost of an excitation circuit and an increase in leaking electromagnetic wave noise.

Moreover, since the heat generating layer is deformed repeatedly at the nip part by the pressing roller (the pressing roller 827 shown in FIG. 20, the outer pressing roller 930 shown in FIG. 21), in the case of the heat generating layer formed by nickel electroforming, a problem of lower mechanical durability of the heat generating layer arises. Further, in the case of the heat generating layer formed from stainless steel, while improved durability is provided, a problem of an increase in warm-up time arises.

DISCLOSURE OF THE INVENTION

In order to solve the above-mentioned problems with the conventional devices, it is an object of the present invention to provide a heating roller and a heating belt that achieve a reduction in warm-up time, prevent a shaft core from being heated so that no deterioration or breakage is caused in bearings, and require no use of a high-frequency power source for heating. Further, it is another object of the present invention to provide an image heating device that achieves a reduction in leaking electromagnetic wave noise, allows rapid heating, and suppresses thermal deterioration of bearings. Moreover, it is still another object of the present invention to provide an image forming apparatus that achieves a reduction in warm-up time and an excellent quality of a fixed image.

In order to achieve the above-mentioned objects, the present invention has the following configurations.

A heating roller according to the present invention is a roller-shaped heating roller including a heat generating layer that generates heat by electromagnetic induction, a heat insulating layer, and a supporting layer, which are provided inwardly in this order. In the heating roller, the heat generating layer is composed of at least two layers that are a first heat generating layer formed of a magnetic material and a second heat generating layer formed of a non-magnetic material. The first heat generating layer has a specific resistance higher than a specific resistance of the second heat generating layer and a thickness larger than a thickness of the second heat generating layer.

A first image heating device according to the present invention includes the above-mentioned heating roller according to the present invention, an excitation unit that heats the heat generating layer by external excitation, and a pressing unit that makes contact under pressure with the heating roller to form a nip part. In the first image heating device, a recording material carrying an image is passed through the nip part so that the image is fixed thermally.

Next, a heating belt according to the present invention is a heating belt including a heat generating layer that generates heat by electromagnetic induction. In the heating belt, the heat generating layer is composed of at least two layers that are a first heat generating layer formed of a magnetic material and a second heat generating layer formed of a non-magnetic material. The first heat generating layer has a specific resistance higher than a specific resistance of the second heat generating layer and a thickness larger than a thickness of the second heat generating layer.

A second image heating device according to the present invention includes the above-mentioned heating belt according to the present invention, an excitation unit that heats the heat generating layer by external excitation, a supporting roller that makes contact internally with and rotatably supports the heating belt, and a pressing unit that makes contact externally with the heating belt to form a nip part. In the second image heating device, a recording material carrying an image is passed through the nip part so that the image is fixed thermally.

Moreover, an image forming apparatus according to the present invention includes an image forming unit in which an unfixed image is formed on a recording material and carried by the recording material and an image heating device that thermally fixes the unfixed image on the recording material. In the image forming apparatus, the image heating device is the above-mentioned first or second image heating device according to the present invention.

BEST MODE FOR CARRYING OUT THE INVENTION

[Embodiment I]

Figure 5:
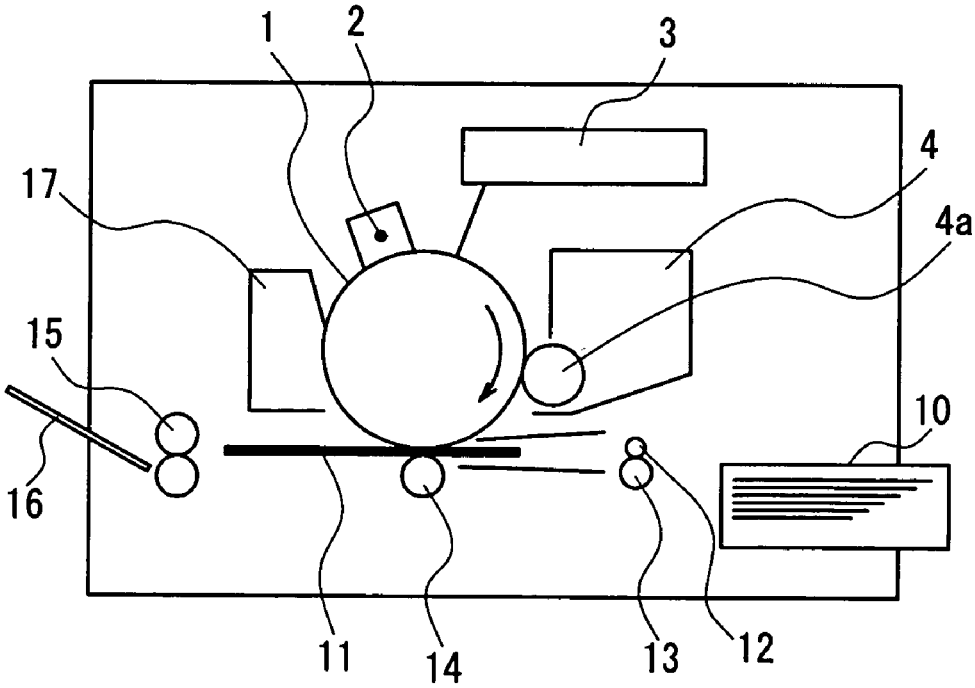
FIG. 5 is a cross sectional view schematically showing a configuration of an image forming apparatus according to Embodiment I of the present invention.

FIG. 5 is a cross sectional view of an example of an image forming apparatus according to the present invention, in which an image heating device is used as a fixing device. An image heating device mounted in an image forming apparatus according to Embodiment I is an electromagnetic induction heating device of the roller heating type. The following description is directed to a configuration and an operation of this device.

Reference numeral 1 denotes an electrophotographic photoreceptor (hereinafter, referred to as a "photosensitive drum"). The photosensitive drum 1, while being driven to rotate at a predetermined peripheral velocity in a direction indicated by an arrow, has its surface charged negatively in a uniform manner to a predetermined dark potential VO by a charger 2.

Reference numeral 3 denotes a laser beam scanner that outputs a laser beam modulated in accordance with a time-series electric digital pixel signal of image information input from a host device such as an image reading apparatus, a computer or the like, which is not shown in the figure. A surface of the photosensitive drum 1 charged in a uniform manner as described above is scanned by and exposed to this laser beam, and thus an absolute potential value of an exposed portion is decreased to a light potential VL. Thus, a static latent image is formed on the surface of the photosensitive drum 1.

Next, the latent image is reversely developed by a developer 4 using negatively charged powdered toner and made manifest.

The developer 4 includes a developing roller 4*a* that is driven to rotate. A thin layer of toner carrying negative electric charge is formed on an outer peripheral face of the roller and opposed to the surface of the photosensitive drum 1. A developing bias voltage, which has an absolute value lower than the dark potential VO of the photosensitive drum 1 and higher than the light potential VL, is applied to the developing roller 4*a*. Thus, the toner on the developing roller 4*a* is transferred only to a portion of the photosensitive drum 1 with the light potential VL, and a latent image is made manifest.

Meanwhile, a recording material (of, for example, paper) 11 is fed one at a time from a paper feeding part 10 and passed between a pair of resist rollers 12 and 13. Then, the recording material 11 is conveyed to a transferring part composed of the photosensitive drum 1 and a transferring roller 14 that is in contact with the photosensitive drum 1, and the timing thereof is appropriate and synchronized with the rotation of the photosensitive drum 1. By the action of the transferring roller 14 to which a transfer bias voltage is applied, toner images on the photosensitive drum 1 are transferred one after another to the recording material 11. The recording material 11 that has been passed through the transferring part is released from the photosensitive drum 1 and introduced to a fixing device 15 where fixing of the transferred toner image is performed. The recording material 11 on which the image is fixed by the fixing process is output to a paper ejecting tray 16.

The surface of the photosensitive drum 1 from which the recording material has been released is cleaned by removing residual materials such as toner remaining after the transferring process by a cleaning device 17 and used repeatedly for successive image formation.

The above-mentioned fixing device 15 includes a heating roller, an excitation unit that heats the heating roller by electromagnetic induction, and a pressing unit that makes contact under pressure with the heating roller to form a nip part.

A heating roller according to the present invention can be used suitably as the heating roller of the above-mentioned fixing device 15 and is a roller-shaped heating roller including a heat generating layer, a heat insulating layer, and a supporting layer, which are provided inwardly in this order. The heat generating layer is composed of at least two layers that are a first heat generating layer formed of a magnetic material and a second heat generating layer formed of a non-magnetic material. The first heat generating layer has a specific resistance higher than a specific resistance of the second heat generating layer and a thickness larger than a thickness of the second heat generating layer.

According to the heating roller described above, the heat generating layer is composed of two layers, and the second heat generating layer is formed of a non-magnetic material. Further, the second heat generating layer has a specific resistance lower than a specific resistance of the first heat generating layer and a thickness smaller than a thickness of the first heat generating layer. Therefore, the second heat generating layer is increased in skin resistance without using a higher driving frequency for an excitation circuit. This allows the second heat generating layer to function effectively as a heat generating part that generates heat by electromagnetic induction. Thus, compared with the case where the heat generating layer is formed only of a single layer of a magnetic material, an increased amount of heat is generated, and heat generation efficiency also is increased, thereby allowing warm-up time to be reduced.

Furthermore, the heat generating layer described above is provided, and thus the heat generating layer is heated intensively. As a result, heat generation of the supporting layer is reduced, thereby allowing the prevention of breakage of, for example, bearings supporting the heating roller.

Furthermore, it is not required that an electric current at a higher frequency be used to generate an excitation magnetic field, thereby preventing an increase in the occurrence of a switching loss in the excitation circuit. Further, a cost increase of the excitation circuit and an increase in leaking electromagnetic wave noise also are prevented.

Furthermore, the heat generating layer can be reduced in thickness, and thus stress generated due to the deformation of the heat generating layer at the nip part is decreased in proportion to a decrease in the thickness of the heat generating layer. This allows the heat generating layer to have increased durability.

Furthermore, the heat generating layer is rotated integrally with the heat insulating layer and the supporting layer, and thus compared with the case of a device of the belt heating type, meandering of the heat generating layer also can be prevented.

Moreover, the excitation unit can be placed outside the heating roller, and thus an excitation coil or the like that constitutes the excitation unit is prevented from being subjected to a high temperature, thereby allowing stable heating to be performed.

Herein, a magnetic material as a material of the first heat generating layer refers to a ferromagnet, possible examples of which include iron, Permalloy, chromium, cobalt, nickel, ferritic stainless steel (SUS430), martensitic stainless steel (SUS416) and the like. Further, a non-magnetic material as a material of the second heat generating layer refers to a paramagnet and a diamagnet, possible examples of which include aluminum, gold, silver, copper, brass, phosphor bronze, titanium and the like.

Preferably, in the above-mentioned heating roller according to the present invention, the second heat generating layer is disposed on an outer side of the first heat generating layer. By disposing the second heat generating layer at a position closer to the excitation unit, regardless of the material and the thickness of the first heat generating layer, passing of magnetic flux through the second heat generating layer is ensured, thereby allowing the second heat generating layer to be heated efficiently by induction heating.

Alternatively, the second heat generating layer may be disposed on each side of the first heat generating layer. This configuration allows the inductance to be decreased further to reduce the generation of magnetic flux. Thus, magnetic flux that penetrates the heat generating layer and then reaches the supporting layer is decreased, thereby reducing heat generation of the supporting layer. Further, leaking electromagnetic wave noise also is reduced.

Furthermore, preferably, in the above-mentioned heating roller according to the present invention, the first heat generating layer is formed of a material having a specific resistance of $9\times10^{-8}$ Ωm or higher, and the second. heat generating layer is formed of a material having a specific resistance of $3\times10^{-8}$ Ωm or lower. In the case where a material having a specific resistance as low as $3\times10^{-8}$ Ωm or lower has a thickness of 2 to 20 μm, the material has a skin resistance equal to a skin resistance of iron. Therefore, by forming the second heat generating layer as a thin layer formed of a material having such a low specific resistance, a considerable effect can be exerted in terms of an increase in an amount of heat generated and an improvement in efficiency. Further, compared with the case without the second heat generating layer, while a thermal capacity of the heat generating layer as a whole is increased slightly, a substantial effect of generating more heat than is required to compensate for the increase in thermal capacity can be obtained, thereby allowing warm-up time to be reduced.

Furthermore, preferably, in the above-mentioned heating roller according to the present invention, the first heat generating layer has a thickness of 10 to 100 μm, and the second heat generating layer has a thickness of 2 to 20 μm. The second heat generating layer having such a small thickness is provided, and thus compared with the case where the heat generating layer is formed only of the first heat generating layer, the following can be achieved. That is, while a thermal capacity of the heat generating layer as a whole is increased slightly, a substantial effect of generating more heat than is required to compensate for the increase in thermal capacity can be obtained, thereby allowing warm-up time to be reduced. Further, it is not preferable that the first and second heat generating layers have thicknesses larger than the thicknesses in the respective ranges mentioned above, because this causes the heat generating layer to be increased in thermal capacity. Further, it is not preferable that the first and second heat generating layers have thicknesses smaller than the thicknesses in the respective ranges mentioned above, because this causes the heat generating layer to be decreased in mechanical strength.

For example, the first heat generating layer may be formed of a magnetic material of stainless steel, and the second heat generating layer may be formed from copper. By the use of stainless steel, durability against repeated deformation at the nip part can be increased. Further, a copper layer is provided, and thus compared with the case where the heat generating layer is formed only of a single layer of stainless steel, a substantial increase in an amount of heat generated and an improvement in heat generation efficiency can be provided.

Furthermore, in the above-mentioned heating roller according to the present invention, the supporting layer may be formed from a non-magnetic metal. Herein, a non-magnetic metal refers to a paramagnet and a diamagnet, possible examples of which include aluminum, brass, austenitic stainless steel (SUS304) and the like. As described above, the heat generating layer is composed of two layers formed respectively of a magnetic material and a non-magnetic material, and thus the inductance is decreased to reduce the generation of magnetic flux, thereby decreasing the magnetic flux that penetrates the heat generating layer and then reaches the supporting layer. Thus, even in the case where the supporting layer is formed of a non-magnetic metallic material (more preferably, with a low specific resistance), namely, a metallic material in general use, heat generation of the supporting layer is limited to a minimal level, thereby allowing the prevention of breakage of bearings or the like. Further, by using a metallic material in general use to form a core material, even the supporting layer with a small diameter can be increased in rigidity, and a cost reduction of the heating roller also can be achieved.

Furthermore, in the above-mentioned heating roller according to the present invention, the supporting layer may be formed of a material having a specific resistance of 1 Ωm or higher. Possible examples of a material having such a high specific resistance include ceramics, ferrite, PEEK (polyether ether ketones), PI (polyimide) and the like. In the case where the heat generating layer is reduced in thickness so as to be decreased in thermal capacity, magnetic flux from the excitation unit may possibly penetrate the heat generating layer and then reach the supporting layer. However, even in such a case, by using a material having a high specific resistance to form the supporting layer, the supporting layer does not generate heat. Thus, no breakage is caused in bearings or the like. Further, the heat generating part can be heated intensively, thereby allowing warm-up time to be reduced further.

Furthermore, in the above-mentioned heating roller according to the present invention, the supporting layer may be formed from ceramics. Examples of ceramics that can be used include alumina, zirconia, aluminum nitride, silicon nitride, silicon carbide and the like. Since ceramics have high rigidity and high heat resistance, by using such ceramics to form the supporting layer, the deformation of the supporting layer is suppressed, and the nip part can be formed so as to be uniform in a width direction of a recording material. Further, even over long hours of operation, the nip part can be maintained stably in such a state. Further, since ceramics are shaped in a molding process with a relatively high degree of freedom, the supporting layer easily can be formed into a desired shape. Further, since ceramics have a high specific resistance, heat generation is not caused, and thus no breakage is caused in bearings or the like, and warm-up time can be reduced.

Furthermore, in the above-mentioned heating roller according to the present invention, the supporting layer may be formed of a material containing at least an oxide magnetic body. Examples of an oxide magnetic body that can be used include nickel-zinc ferrite, barium ferrite and the like. Further, a composite magnetic body formed by solidifying a mixture of ferrite powder of these materials and rubber, plastic or the like also may be used. Oxide magnetic bodies are less costly materials having high rigidity and a relatively high degree of freedom of shape. Further, oxide magnetic bodies have high magnetic permeability, and thus magnetic coupling between an oxide magnetic body and the excitation unit is enhanced, thereby allowing warm-up time to be reduced. Further, although passage of magnetic flux through an oxide magnetic body is ensured, the oxide magnetic body has a high specific resistance, and thus the supporting layer is not caused to generate heat under an excitation magnetic field.

Furthermore, in the above-mentioned heating roller according to the present invention, the supporting layer may be composed of a rotary shaft and a shielding layer formed on a surface of the rotary shaft, and the shielding layer may be formed of a material containing at least an oxide magnetic body. Examples of an oxide magnetic body that can be used include nickel-zinc ferrite, barium ferrite and the like. Further, a composite magnetic body formed by solidifying a mixture of ferrite powder of these materials and rubber, plastic or the like also may be used. Since the shielding layer is formed of a material containing an oxide magnetic body, the magnetic permeability of the shielding layer is increased. Therefore, magnetic flux that has penetrated the heat generating layer passes through the shielding layer and thus is prevented from passing through the rotary shaft. Thus, regardless of a material of the rotary shaft, heat generation in the rotary shaft can be prevented. Further, magnetic coupling between the shielding layer and the excitation unit is enhanced, and thus a larger output can be produced by induction heating, thereby allowing warm-up time to be reduced.

Preferably, in this case, the rotary shaft is formed from a non-magnetic metal. Herein, a non-magnetic metal refers to a paramagnet and a diamagnet, possible examples of which include aluminum, brass, austenitic stainless steel (SUS304) and the like. The shielding layer formed of a material containing an oxide magnetic body is provided as described above, and thus passing of magnetic flux though the rotary shaft can be suppressed. Thus, even in the case where the rotary shaft is formed of a non-magnetic metallic material (more preferably, with a low specific resistance), namely a metallic material in general use, heat generation of the rotary shaft is limited to a minimal level, thereby allowing the prevention of breakage of bearings or the like. Further, by using a metallic material in general use to form the rotary shaft, even the supporting layer with a small diameter can be increased in rigidity, and a cost reduction of the heating roller also can be achieved.

An image heating device according to the present invention includes the above-mentioned heating roller according to the present invention, an excitation unit that heats the heat generating layer by external excitation, and a pressing unit that makes contact under pressure with the heating roller to form a nip part. In the image heating device, the recording material 11 carrying an image is passed through the nip part so that the image is fixed thermally.

According to this configuration, an image heating device can be provided that allows the heating roller to be heated rapidly without causing breakage of a bearing part of the heating roller and achieves a reduction in leaking electromagnetic wave noise.

Preferably, in the above-mentioned image heating device according to the present invention, the excitation unit has a driving frequency of 20 kHz to 50 kHz. The use of a frequency above this range requires a costly constituent element, which results in a cost increase of an excitation circuit. Further, this causes the occurrence of a switching loss and leakage electromagnetic wave noise to be increased. Further, the use of a frequency below this range hinders efficient heat generation of the thin heat generating layer.

Furthermore, an image forming apparatus. according to the present invention includes an image forming unit in which an unfixed image is formed on a recording material and carried by the recording material and an image heating device that thermally fixes the unfixed image on the recording material. In the image forming apparatus, the image heating device is the above-mentioned image heating device according to the present invention.

According to this configuration, an image forming apparatus can be obtained that achieves a reduction in warm-up time and an excellent quality of a fixed image.

Hereinafter, an embodiment of the heating roller according to the present invention and the image heating device according to the present invention that is used as the above-mentioned fixing device 15 will be described in detail by way of specific examples (examples).

(Embodiment I-1)

Figure 1:
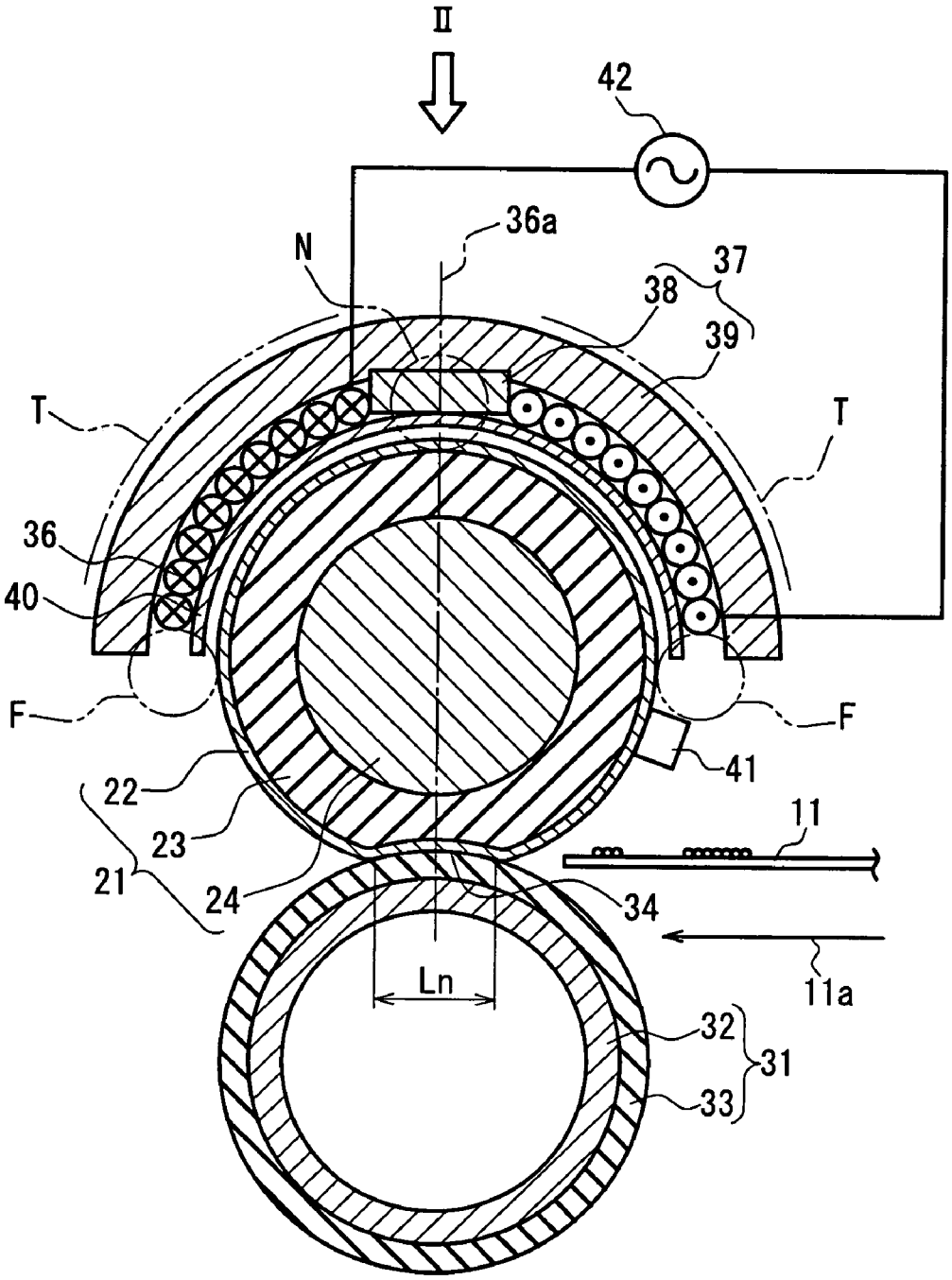
FIG. 1 is a cross sectional view of an image heating device according to Embodiment I-1 of the present invention.
Figure 2:
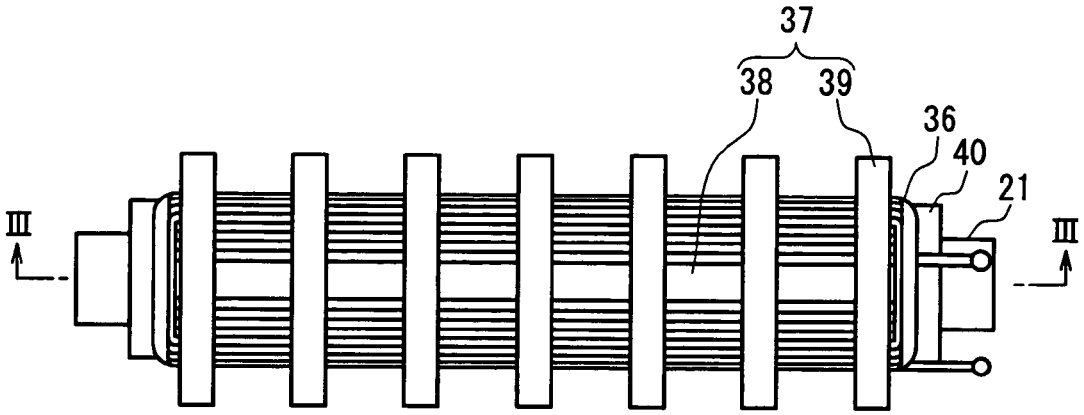
FIG. 2 is a structural view of an excitation unit as seen from a direction indicated by an arrow II of FIG. 1.
Figure 3:
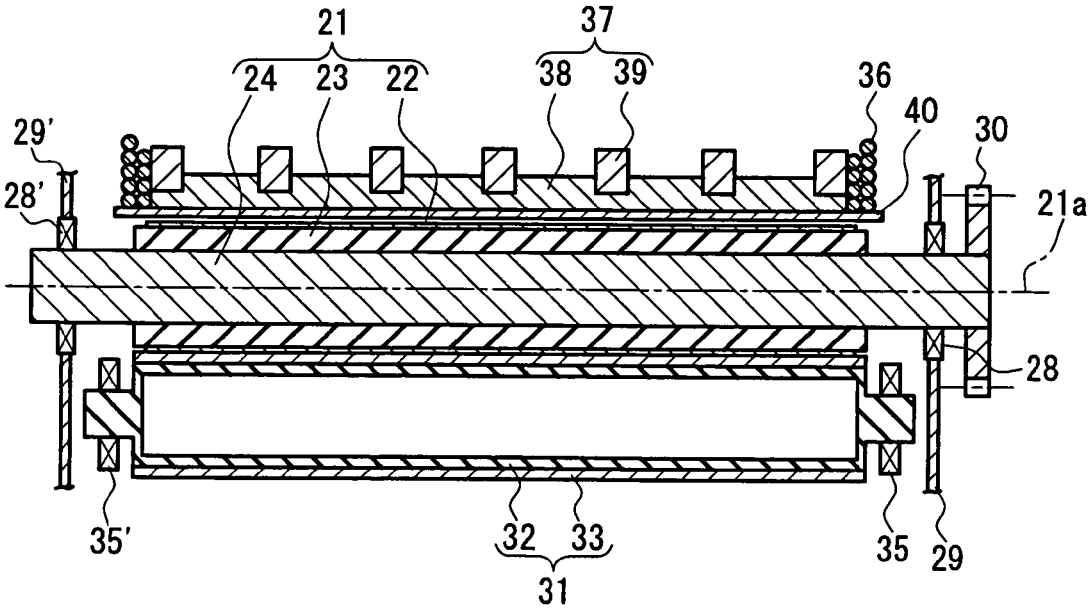
FIG. 3 is a cross sectional view taken on line III—III of FIG. 2 for showing the image heating device according to Embodiment I-1 of the present invention.
Figure 4:
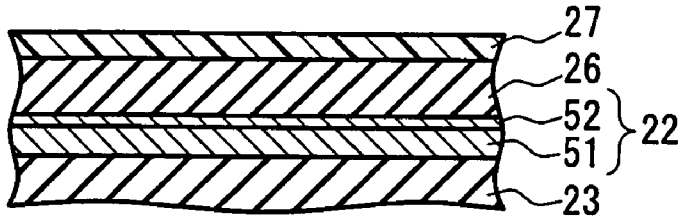
FIG. 4 is a partial cross sectional view of a surface layer portion of a heating roller including a heat generating layer, which is used in the image heating device according to Embodiment I-1 of the present invention.

FIG. 1 is a cross sectional view of an image heating device as a fixing device according to Embodiment I-1 of the present invention, which is used in the above-mentioned image forming apparatus shown in FIG. 5. FIG. 2 is a structural view of an excitation unit as seen from a direction indicated by an arrow II of FIG. 1. FIG. 3 is a perspective sectional view taken on line III—III (a plane including a rotation center axis 21*a* of a heating roller 21 and a winding center axis 36*a* of an excitation coil 36) of FIG. 2. FIG. 4 is a cross sectional view showing a layer configuration of a surface layer portion of the heating roller 21 including a heat generating layer 22.

Reference numeral 21 denotes the heating roller that is composed of the heat generating layer 22 formed of a thin conductive material, a heat insulating layer 23 formed of a material having low thermal conductivity, and a supporting layer 24 as a rotary shaft, which are provided in this order from a surface side so as to be in close contact with each other.

As shown in FIG. 4, the heat generating layer 22 is composed of a first heat generating layer 51 on a side of the heat insulating layer 23 and a second heat generating layer 52 provided on an outer side of the first heat generating layer 51. A thin elastic layer 26 is formed on a surface of the second heat generating layer 52, and a mold releasing layer 27 is formed further on a surface of the elastic layer 26.

The first heat generating layer 51 is formed of a magnetic material of, preferably, a magnetic metal. In an example, as the first heat generating layer 51, a thin endless belt-like material of 40 $\mu$m thickness that is formed from magnetic stainless steel SUS430 (specific resistance: $6\times10^{-7}$ Ωm) was used. A material of the first heat generating layer 51 is not limited to SUS430, and metals such as nickel, iron, chromium and the like and alloys of these metals also may be used.

The second heat generating layer 52 is formed of a non-magnetic material and has a specific resistance lower than a specific resistance of the first heat generating layer 51 and a thickness smaller than a thickness of the first heat generating layer 51. In the example, the second heat generating layer 52 was formed by plating a surface of the first heat generating layer 51 with copper (specific resistance: $1.7\times10^{8}$ $\mu$m) in a thickness of 5 $\mu$m. A material of the second heat generating layer 52 is not limited to copper and also may be silver, aluminum or the like. A method of forming the second heat generating layer 52 is not limited to plating, and the second heat generating layer 52 may be formed also by metalizing or the like.

Furthermore, the heat generating layer 22 also may be formed of an endless belt-like material of a clad material preformed by joining magnetic stainless steel SUS430 to copper.

The elastic layer 26 is provided so as to improve adhesion to a recording material. In the example, the elastic layer 26 was formed from silicone rubber and had a thickness of 200 $\mu$m and a hardness of 20 degrees (JIS-A). Although a configuration without the elastic layer 26 poses no problem, it is desirable to provide the elastic layer 26 in the case of obtaining a color image. The thickness of the elastic layer 26 is not limited to 200 $\mu$m, and it is desirable to set the thickness to be in a range of 50 $\mu$m to 500 $\mu$m. In the case where the elastic layer 26 has a thickness larger than thicknesses in the above-mentioned range, the thermal capacity becomes too large, thereby requiring a longer warm-up time. In the case where the elastic layer 26 has a thickness smaller than thicknesses in the above-mentioned range, the effect of providing adhesion to a recording material no longer is exerted. A material of the elastic layer 26 is not limited to silicone rubber, and other types of heat-resistant rubber and resin also may be used.

The mold releasing layer 27 is formed from a fluorocarbon resin such as PTFE (polytetrafluoroethylene), PFA (tetrafluoroethylene-perfluoroalkylvinyl ether copolymer), FEP (tetrafluoroethylene hexafluoropropylene copolymer) or the like. In the example, the mold releasing layer 27 was formed of a fluorocarbon resin layer having a thickness of 30 $\mu$m.

Preferably, the supporting layer 24 is formed from a non-magnetic metal. In the example, the supporting layer 24 was formed from aluminum having a specific resistance of $2.65\times10^{8}$ Ωm and had a diameter of 20 mm.

The heat insulating layer 23 is formed of a foamed elastic body having low thermal conductivity. It is desirable that the heat insulating layer 23 have a hardness of 20 to 55 degrees (ASKER-C). In the example, the heat insulating layer 23 was formed of a 5-mm thick foam body (thermal conductivity: 0.24 W/m·K) formed from silicone rubber. Further, the heat insulating layer 23 had a hardness of 45 degrees (ASKER-C) and elasticity.

In the example, the heating roller 21 had a diameter of 30 mm and an effective length allowing a margin with respect to a width (short side length) of a JIS size A4 paper sheet. The heat generating layer 22 is formed to have a width (length in a direction of a rotation axis center of the heating roller 21) that is slightly shorter than a width of the heat insulating layer 23 (see FIG. 3).

In the example, the heat generating layer 22 was bonded to the heat insulating layer 23. In this case, since the heat insulating layer 23 has elasticity, a configuration also is possible in which instead of being bonded, the heat generating layer 22 in the shape of an endless belt is fit on an outer periphery of the heat insulating layer 23 so as to be fixed thereto.

FIG. 3 is a perspective sectional view taken on line III—III of FIG. 2 and shows the configuration of the whole fixing device as seen from a lateral direction.

The heating roller 21 is held rotatably in such a manner that both ends of the supporting layer 24, which is the lowest layer of the heating roller 21, are supported by bearings 28 and 28' attached respectively to side plates 29 and 29'. Further, the heating roller 21 is driven to rotate by a driving unit of a main body of an apparatus, which is not shown in the figure, through a gear 30 fixed integrally to the supporting layer 24.

Further, reference numeral 36 denotes the excitation coil constituting the excitation unit. The excitation coil 36 is disposed so as to be opposed to a cylindrical face on an outer periphery of the heating roller 21. Further, the excitation coil 36 includes nine turns of a wire bundle composed of 60 wires of a copper wire with its surface insulated, which has an outer diameter of 0.15 mm.

The wire bundle of the excitation coil 36 is arranged, at end portions of the cylindrical face of the heating roller 21 in a direction of the rotation center axis 21*a*, in the form of an arc along outer peripheral faces of the end portions. The wire bundle is arranged, in a portion other than the end portions, along a generatrix of the cylindrical face. As shown in FIG. 1, which is a cross section orthogonal to the rotation center axis 21*a* of the heating roller 21, the wire bundle of the excitation coil 36 is arranged tightly without being overlapped (except in the end portions of the heating roller 21) on an assumed cylindrical face formed around the rotation center axis 21*a* of the heating roller 21 so as to cover the cylindrical face of the heating roller 21. Further, as shown in FIG. 3, which is a cross section including the rotation center axis 21*a* of the heating roller 21, in portions opposed to the end portions of the heating roller 21, the wire bundle of the excitation coil 36 is overlapped in two rows and thus forced into bulges. Thus, the whole excitation coil 36 is formed into a saddle-like shape. The winding center axis 36*a* of the excitation coil 36 is a straight line substantially orthogonal to the rotation center axis 21*a* of the heating roller 21, which passes through substantially a center point of the heating roller 21 in the direction of the rotation center axis 21*a*. The excitation coil 36 is formed so as to be substantially symmetrical with respect to the winding center axis 36*a*. The wire bundle is wound so that adjacent turns of the wire bundle are bonded to each other with an adhesive applied to their surface, thereby maintaining a shape shown in the figure. The excitation coil 36 is opposed to the heating roller 21 at a distance of about 2 mm from the outer peripheral face of the heating roller 21. In the cross section shown in FIG. 1, the excitation coil 36 is opposed to the outer peripheral face of the heating roller 21 in a large area defined by an angle of about 180 degrees with respect to the rotation center axis 21*a* of the heating roller.

Reference numeral 37 denotes a rear core, which together with the excitation coil 36, constitutes the excitation unit. The rear core 37 is composed of a bar-like central core 38 and a substantially U-shaped core 39. The central core 38 passes through the winding center axis 36*a* of the excitation coil 36 and is arranged parallel to the rotation center axis 21*a* of the heating roller 21. The U-shaped core 39 is arranged at a distance from the excitation coil 36 on a side opposite to that of the heating roller 21 with respect to the excitation coil 36. The central core 38 and the U-shaped core 39 are connected magnetically. As shown in FIG. 1, the U-shaped core 39 is of a U shape substantially symmetrical with respect to a plane including the rotation center axis 21*a* of the heating roller 21 and the winding center axis 36*a* of the excitation coil 36. As shown in FIGS. 2 and 3, a plurality of the U-shaped cores 39 described above are arranged at a distance from each other in the direction of the rotation center axis 21*a* of the heating roller 21. In the example, the width of the U-shaped core 39 in the direction of the rotation center axis 21*a* of the heating roller 21 was 10 mm, and seven U-shaped cores 39 in total were arranged at a distance of 26 mm from each other. The U-shaped cores 39 capture magnetic flux from the excitation coil 36, which leaks to the exterior.

As shown in FIG. 1, both ends of each of the U-shaped cores 39 are extended to areas that are not opposed to the excitation coil 36, so that opposing portions F are formed, which are opposed to the heating roller 21 without the excitation coil 36 interposed between them. In contrast to the opposing portion F, portions of the U-shaped core 39 that are opposed to the heating roller 21 through the excitation coil 36 are referred to as magnetically permeable portions T. Further, the central core 38 is opposed to the heating roller 21 without the excitation coil 36 interposed between them and protrudes further than the U-shaped core 39 to a side of the heating roller 21 to form an opposing portion N. The opposing portion N of the protruding central core 38 is inserted into a hollow portion of a winding center of the excitation coil 36. In the example, the central core 38 had a cross-sectional area of 4 mm by 10 mm.

The rear core 37 can be formed from, for example, ferrite. As a material of the rear core 37, it is desirable to use a material having high magnetic permeability and a high specific resistance such as ferrite and Permalloy. However, a material having somewhat low magnetic permeability can be used as long as the material is a magnetic material.

Reference numeral 40 denotes a heat insulating member that is formed from a resin having high heat resistance such as PEEK (polyether ether ketones), PPS (polyphenylene sulfide) or the like. In the example, the heat insulating member had a thickness of 1 mm.

Referring back to FIG. 1, a pressing roller 31 as a pressing unit is composed of a metal shaft 32 and an elastic layer 33 of silicone rubber that is laminated on a surface of the metal shaft 32. The elastic layer 33 has a hardness of 50 degrees (JIS-A) and is in contact under pressure with the heating roller 21 with a force of about 200 N in total to form a nip part 34.

The effective length of the pressing roller 31 is, while being substantially equal to the effective length of the heating roller 21, slightly longer than the width of the heat generating layer 22 (see FIG. 3). Therefore, pressure is applied to the heat generating layer 22 uniformly along an entire width between the heat insulating layer 23 of the heating roller 21 and the pressing roller 31. The pressing roller 31 is a follower roller that is supported rotatably by bearings 35 and 35' on both ends of the metal shaft 32.

Since the elastic layer 33 of the pressing roller 31 has a hardness higher than a hardness of a surface of the heating roller 21, as shown in FIG. 1, at the nip part 34, the heat generating layer 22 and the heat insulating layer 23 of the heating roller 21 are deformed into the shape of a concave along an outer peripheral face of the pressing roller 31. In the example, at the nip part 34, a nip length Ln (length of a deformed portion of the surface of the heating roller 21 at the nip part 34 along a traveling direction 11*a* of a recording material 11 (see FIG. 1)) was about 5.5 mm. Although an extremely large pressing force is applied to the heating roller 21 by the pressing roller 31, the nip length Ln at the nip part 34 is substantially the same in the direction of the rotation axis center of the heating roller 21. This can be achieved because: the solid supporting layer 24 bears the pressing force, and thus distortion of the heating roller 21 with respect to the rotation center axis 21*a* is suppressed to a minimal amount; and the thin heat generating layer 22 is supported by the supporting layer 24 through the heat insulating layer 23.

Furthermore, at the nip part 34, an outer surface of the heating roller 21 is deformed into the shape of a concave along an outer surface of the pressing roller 31. Thus, a traveling direction of the recording material 11 coming out of the nip part 34 forms an increased angle with the outer surface of the heating roller 21, thereby providing an excellent peeling property that allows the recording material 11 to be peeled off the heating roller 21.

As a material of the elastic layer 33 of the pressing roller 31, as well as the above-mentioned silicone rubber, heat-resistance resin and rubber such as fluorocarbon rubber, fluorocarbon resin and the like may be used. Further, in order to obtain improved abrasion resistance and mold releasability, a surface of the pressing roller 31 may be coated with a single material or a combination of materials selected from resin and rubber such as PFA, PTFE, FEP and the like. In order to prevent heat dissipation, it is desirable that the pressing roller 31 be formed of a material having low thermal conductivity.

In FIG. 1, reference numeral 41 denotes a temperature detecting sensor that slides while being in contact with the surface of the heating roller 21 so as to detect the temperature of the surface of the heating roller 21 at a portion right before entering the nip part 34, and feeds back a result of the detection to a controlling circuit that is not shown in the figure. In the example, during operation, this function was used to regulate the excitation power of an excitation circuit 42 so that the surface of the heating roller 21 at a portion right before entering the nip part 34 of the heating roller 21 was controlled so as to be at a temperature of 170 degrees centigrade. In this embodiment, in order to achieve the object of reducing warm-up time, the heat generating layer 22 is set so as to have an extremely small thermal capacity.

The above-mentioned heating roller 21 and the excitation unit composed of the excitation coil 36 and the rear core 37 cause an eddy current to be generated in the heat generating layer 22 of the heating roller 21, so that the heat generating layer 22 generates heat. Hereinafter, this function will be described with reference to FIG. 6. For the sake of simplicity, the description is based on the assumption that the heat generating layer 22, while actually having a two-layer configuration, is of a single-layer configuration.

Figure 6:
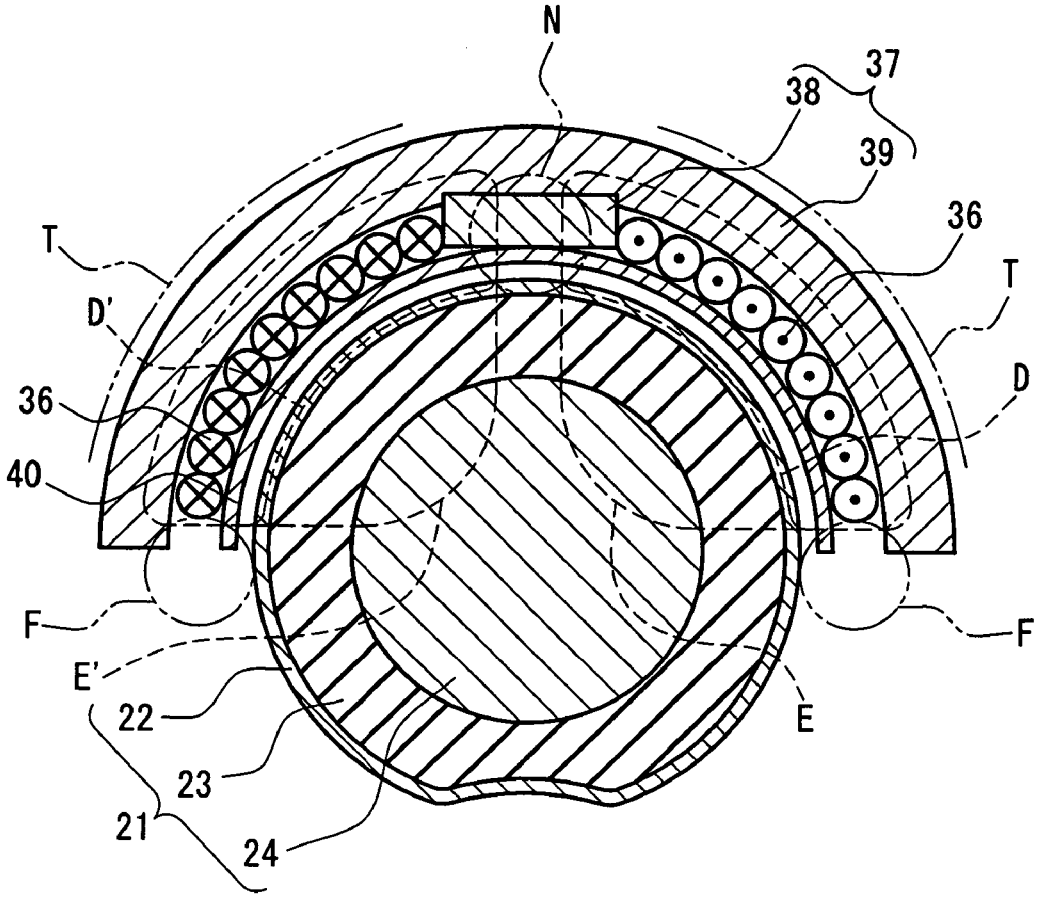
FIG. 6 is a cross sectional view for explaining a mechanism in which the excitation unit causes the heating roller to generate heat by electromagnetic induction in the image heating device according to Embodiment I-1 of the present invention.

In FIG. 6, magnetic flux generated at a particular moment by the excitation coil 36 enters the heat generating layer 22 of the heating roller 21 from the opposing portion N where the central core 38 is opposed to the heating roller 21 and passes through the heat generating layer 22. Then, the magnetic flux enters the U-shaped core 39 from the opposing portion F, passes though the U-shaped core 39, and returns to the central core 38. In the case where the heat generating layer 22 has a thickness larger than a skin depth, due to the magnetism of the heat generating layer 22, as shown by dotted lines D and D' in the figure, most of the magnetic flux passes through the heat generating layer 22. Most of eddy current generated by a phenomenon in which magnetic flux is generated and disappears repeatedly is generated only in the heat generating layer 22 by a skin effect, so that Joule heat is generated in the heat generating layer 22.

Herein, the skin depth is determined by the material of a member through which the magnetic flux passes and a frequency of an AC magnetic field. Calculation shows that, in the case where magnetic stainless steel SUS430 is used and an excitation current has a frequency of 25 kHz, a skin depth of about 0.25 mm is obtained. If the heat generating layer 22 has a thickness equal to or larger than this skin depth, most of the eddy current is generated in the heat generating layer 22. Accordingly, magnetic flux hardly reaches the supporting layer 24, so that even in the case where the supporting layer 24 is formed of a metallic material having a low specific resistance, an eddy current hardly is generated in the supporting layer 24. Thus, the supporting layer 24 does not generate heat, and no substantial influence is exerted on heat generation of the heat generating layer 22.

However, in the case where the heat generating layer 22 is set so as to have a thickness larger than the skin depth, the heat generating layer 22 is increased in thermal capacity, and thus a warm-up time cannot be reduced. In this embodiment, in order to reduce the thermal capacity, the heat generating layer 22 was set to have a thickness of 45 $\mu$m as a total thickness of the two layers. In order to obtain a skin depth of not more than 45 $\mu$m, i.e. the thickness of the heat generating layer 22, it is necessary to use an electric current at a frequency of about 900 kHz. However, this leads to problems such as a switching loss and a cost increase of the excitation circuit 42, electromagnetic wave noise leaking to the exterior and the like and thus hardly can be put into practice.

Generally, in performing electromagnetic induction heating, a material having a high skin resistance value is used in a heat generating part. When a high-frequency current at 25 kHz is fed through an excitation coil, magnetic stainless steel SUS430 and iron present high skin resistance values of $24.4\times10^{-4}$ Ω and $9.8\times10^{-4}$ Ω, respectively, and thus generate heat efficiently. Meanwhile, aluminum and copper, which are non-magnetic materials, present low skin resistance values of $0.51\times10^{-4}$ Ω and $0.41\times10^{-4}$ Ω, respectively. Therefore, presumably, in each of the cases of exerting magnetic flux on these materials, a counter magnetic field is generated to cause a flow of a counter current, so that the magnetic flux is hindered from passing through a non-magnetic metal, thereby failing to achieve electromagnetic induction heating. However, even a non-magnetic metal, with its thickness reduced, is increased in skin resistance value. This allows the generation of a counter magnetic field to be suppressed, so that it is made easier for magnetic flux to pass through an inner portion of the non-magnetic metal, thereby allowing the electromagnetic induction heating to be achieved.

In the present invention, this phenomenon is utilized, and by using a combination of a non-magnetic metal layer and a magnetic metal layer to form the heat generating layer 22, more efficient heating can be achieved compared with the case where the heat generating layer 22 is formed of a single layer of a magnetic metal.

Figure 7:
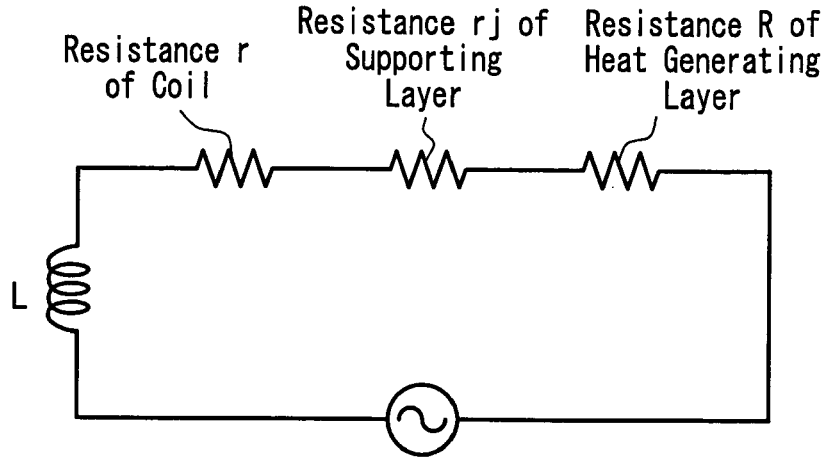
FIG. 7 is an equivalent circuit diagram showing an electromagnetic induction heating part of the image heating device according to Embodiment I-1 of the present invention.

FIG. 7 shows an equivalent circuit of the excitation coil 36 and the heating roller 21 in an electromagnetic induction heating part of the image heating device according to this embodiment. Reference character r denotes a resistance of the excitation coil 36 itself. Further, reference character rj denotes a resistance resulting from electromagnetic coupling between the excitation coil 36 and the supporting layer 24 of the heating roller 21, which corresponds to a resistance used to cause the supporting layer 24 to generate heat under magnetic flux passing through the supporting layer 24. Further, reference character R denotes a resistance resulting from electromagnetic coupling between the excitation coil 36 and the heat generating layer 22, which corresponds to a resistance used to cause the heat generating layer 22 to generate heat. Reference character L denotes an inductance of the circuit as a whole. Assuming that the efficiency of the electromagnetic induction heating part is denoted as η, the equation $\eta=R/(r+rj+R)\times100$ is obtained.

Figure 8:
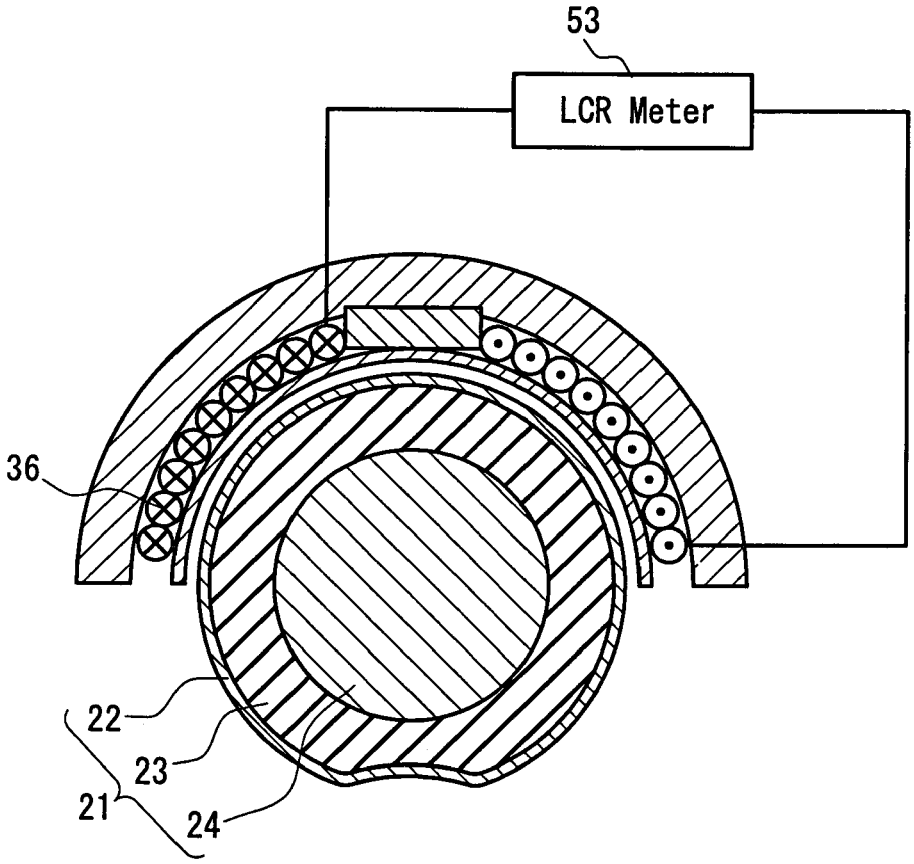
FIG. 8 is a schematic sectional view for explaining a method of determining characteristics of the electromagnetic induction heating part of the image heating device according to Embodiment I-1 of the present invention.

FIG. 8 is schematic diagram showing a configuration of the device that is used to measure resistance values of the respective portions, which are necessary to determine the efficiency η of the electromagnetic induction heating part of the image heating device. As shown in the figure, a measuring instrument (LCR meter) 53 was connected across the excitation coil 36, and an impedance of the excitation coil 36 was measured under the following three conditions. Under a first condition, in a state where the excitation coil 36 is opposed to the heating roller 21, the excitation coil 36 was supplied with electric current for the measurement at a frequency varying from 0 to 200 kHz, and a resistance component thus obtained was denoted as Rt. Under a second condition, the heating roller 21 without the heat generating layer 22 was opposed to the excitation coil 36. With respect to the heating roller 21 in that state, the same measurement was performed, and a resistance component thus obtained was denoted as Ru. Under a third condition, in a state where the heating roller 21 is not opposed to the excitation coil 36, the same measurement was performed, and a resistance thus obtained was denoted as r. Thus, the resistance r refers to a resistance of the excitation coil 36 itself, and the resistance R used to cause the heat generating layer 22 to generate heat can be determined by the equation R=Rt−Ru. Further, the resistance rj used to cause the supporting layer 24 to generate heat can be determined by the equation rj=Ru−r.

Figure 9:
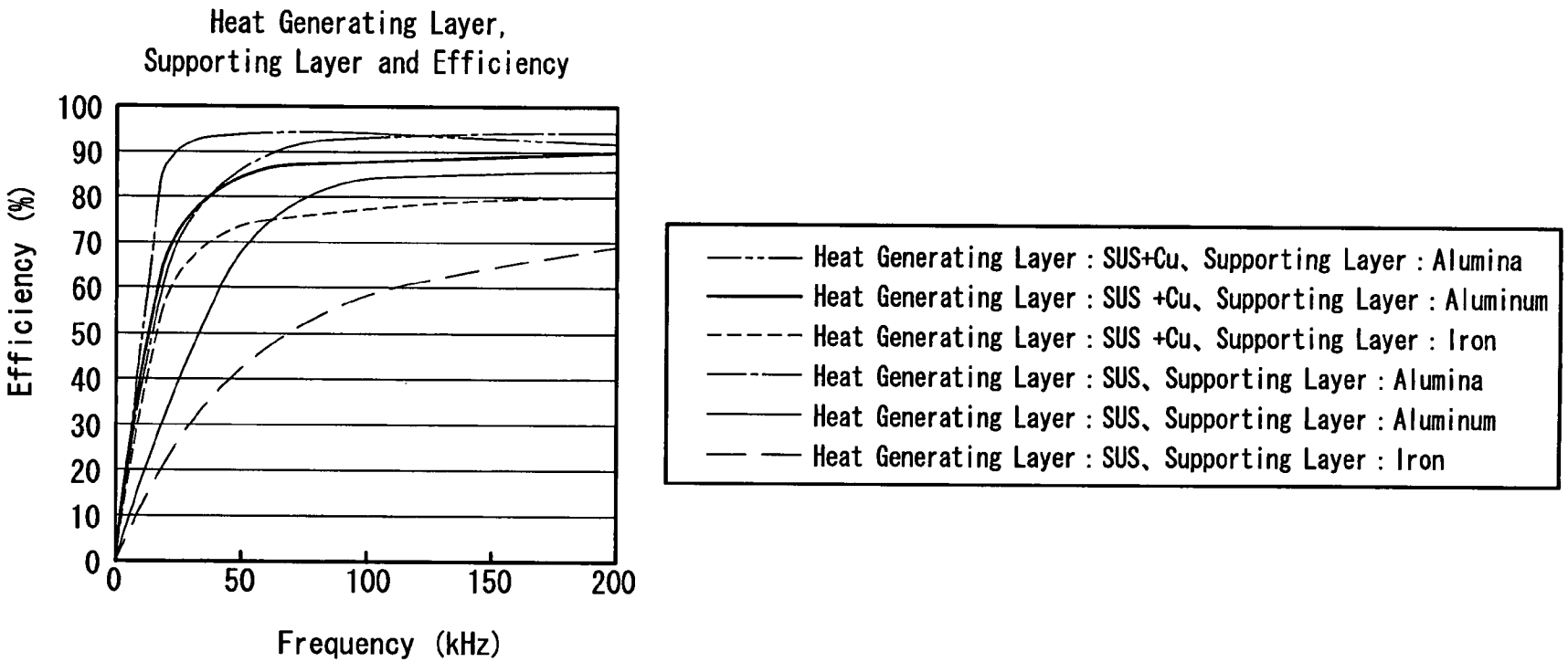
FIG. 9 is a graph showing the results of a test performed to determine efficiency depending on the respective materials of the heat generating layer and a supporting layer of the heating roller in each of the image heating devices according to Embodiments I-1 and I-2 of the present invention.

The above-mentioned measurement was performed for each of six types of heating rollers in total obtained by combining the following two cases related to the heat generating layer 22 and three cases related to the supporting layer 24. Related to the heat generating layer 22 are a case where the heat generating layer 22 is formed of a 40-$\mu$m thick single layer of SUS430 and a case where the heat generating layer 22 has a two-layer configuration obtained by plating a 40-$\mu$m thick SUS430 layer with copper in a thickness of 5 $\mu$m. Further, related to the supporting layer 24 are the respective cases of using, as a material of the supporting layer 24, aluminum, iron, and alumina in the form of ceramic, respectively. Then, the efficiency η to be obtained when using each of the heating rollers was determined. FIG. 9 shows the results of the determination.

As is apparent from these results, in any of the cases of using the respective materials as a material of the supporting layer 24, compared with the case of the heat generating layer 22 formed of a single layer of SUS430, increased efficiency is obtained in the case of the heat generating layer 22 composed of two layers that are the SUS430 layer and a copper plating layer. Particularly, substantial improvements are made at a frequency in a region of low electric current frequencies of 50 kHz or lower. Further, as for a material of the supporting layer 24, higher efficiency can be obtained by using aluminum than in the case of using iron.

Figure 10:
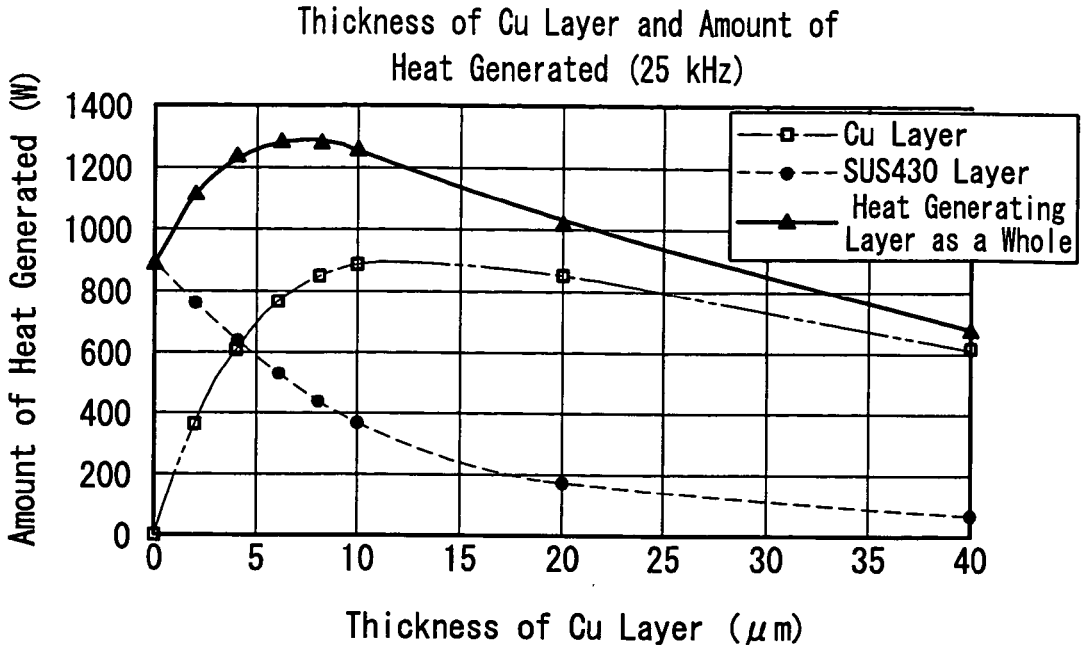
FIG. 10 is a graph showing results of an analysis of a relationship between a thickness of a copper plating layer and an amount of heat generated, in the image heating device according to Embodiment I-1 of the present invention.

Furthermore, with respect to the heat generating layer 22 formed of a 40-$\mu$m thick SUS430 layer with a copper plating layer formed thereon, an analysis was made to determine a change in an amount of heat generated when the copper plating layer varied in thickness. FIG. 10 shows the results of the determination. The results are based on a condition in which an electric current at a constant frequency of 25 kHz is used and the excitation circuit 42 also has a constant electric current value. In FIG. 10, as well as an amount of heat generated in the heat generating layer 22 as a whole, an amount of heat generated in a portion of the copper plating layer and an amount of heat generated in a portion of the SUS430 layer are determined by analyses and also are shown. As is apparent from these results, where the copper plating layer has a thickness in a range of not more than about 25 $\mu$m, in the case of the heat generating layer 22 having the copper plating layer, a larger amount of heat is generated in the heat generating layer 22 as a whole than in the case of the heat generating layer 22 without the copper plating layer (thickness of the copper plating layer =0 $\mu$m). Particularly, where the copper plating layer has a thickness in a range of 1 to 20 $\mu$m, a substantially increased amount of heat is generated in the heat generating layer 22 as a whole. Further, the thicker the copper plating layer, the smaller the amount of heat generated in the SUS430 layer. This indicates that the magnetic flux passing through the SUS430 layer is decreased. Therefore, the magnetic flux reaching the supporting layer 24 also is decreased, and thus an amount of heat generated in the supporting layer 24 is decreased. This indicates that the heat generating layer 22 is heated efficiently.

Figure 11:
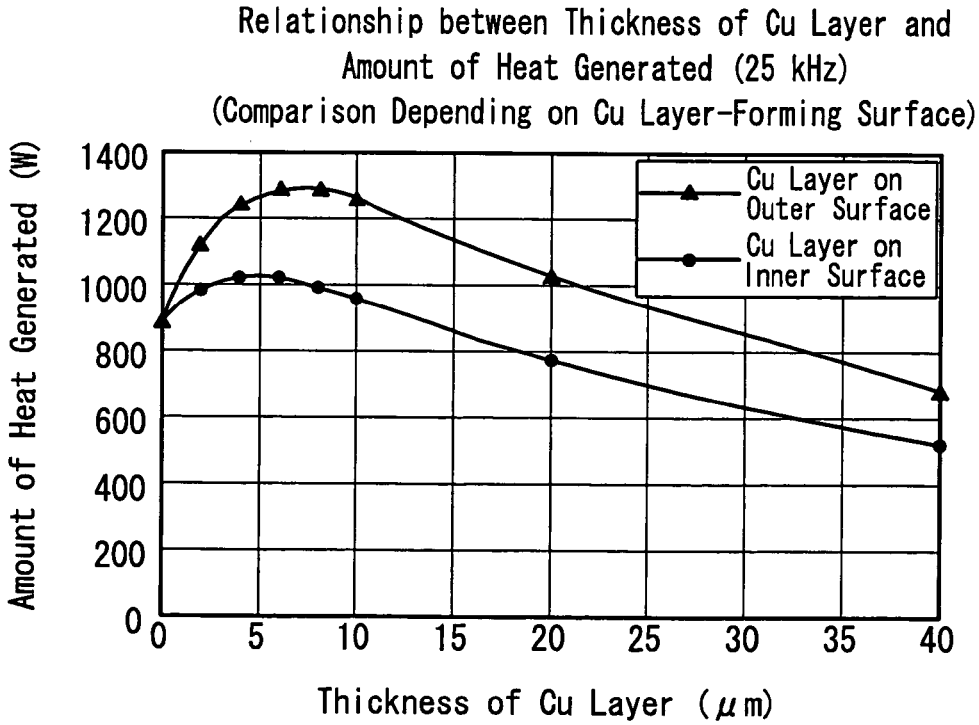
FIG. 11 is a graph showing results of an analysis of a relationship between both a layer-forming surface and a thickness of the copper plating layer and an amount of heat generated, in the image heating device according to Embodiment I-1 of the present invention.

Furthermore, with respect to the following cases related to the heat generating layer 22, an analysis was made to determine a change in an amount of heat generated when the copper plating layer varied in thickness. In one of the cases, the heat generating layer 22 was formed of a 40-$\mu$m thick SUS430 layer with a copper plating layer formed only on an outer surface thereof, and in the other of the cases, the heat generating layer 22 was formed of a 40-$\mu$m thick SUS430 layer with a copper plating layer formed only on an inner surface thereof. FIG. 11 shows the results of the determination. The results are based on a condition in which an electric current at a constant frequency of 25 kHz is used and the excitation circuit 42 also has a constant current value. As is apparent from these results, in the case of applying copper plating to the outer surface of the SUS430 layer, a larger amount of heat is generated compared with the case of applying copper plating to the inner surface of the SUS430 layer. Where the thickness of the copper plating layer is the same, namely, where the thermal capacity of the heat generating layer 22 is the same, the case of forming the copper plating layer (non-magnetic layer) on the outer surface, namely, on a surface closer to the excitation unit provides a more substantial effect of increasing an amount of heat generated, and thus heat generation can be performed more efficiently, thereby allowing warm-up time to be reduced.

While being driven to rotate, the fixing device having the above-mentioned configuration was supplied with a power of 800 W at 25 kHz so that warming up was started from room temperature. Monitoring of the output of the temperature detecting sensor 41 showed that the temperature of the surface of the heating roller 21 reached 170 degrees centigrade after a lapse of about 13 seconds from a start of the power supply. Heat generation of the supporting layer 24 was at a minimal level, and thus breakage was not caused in the bearings 28 and 28' (see FIG. 3).

In the above-mentioned example, SUS430 was used as a material of the first heat generating layer 51. However, the same effect can be attained also in the cases of using other magnetic metals such as iron, nickel and the like. Further, copper was used as a material of the second heat generating layer 52. However, the same effect can be attained also in the cases of using other non-magnetic metals such as gold, silver, aluminum and the like.

In the image forming apparatus shown in FIG. 5, in which the fixing device having the above-mentioned configuration is provided, as shown in FIG. 1, the recording material 11 to which a toner image had been transferred was allowed to enter in the direction indicated by an arrow 11*a* so that toner on the recording material 11 was fixed.

In this embodiment, in order to achieve the object of reducing warm-up time, the heat generating layer 22 was set to have a thickness smaller than the skin depth, and this heat generating layer 22 was heated externally with efficiency by electromagnetic induction. The heat generating layer 22 was formed as a thin layer (having a total thickness of 45 $\mu$m in the example). Therefore, the heat generating layer 22 has low rigidity and thus is easily deformed along the outer peripheral face of the pressing roller 31, thereby exhibiting an excellent peeling property of allowing the heat generating layer 22 to be peeled off the recording material 11. Moreover, with the reduction in thickness of the heat generating layer 22, even when the heat generating layer 22 is deformed repeatedly along the outer peripheral face of the pressing roller 31, stress generated in the heat generating layer 22 being deformed also is decreased in proportion to a decrease in thickness of the heat generating layer 22. Thus, the heat generating layer 22 has increased durability.

Furthermore, generally, the smaller the thermal capacity of a heating roller, the more sharply the temperature of a surface of the heating roller at a portion passing through a nip part is decreased due to heat absorption by a recording material and the like. On the other hand, in this embodiment, the elastic layer 26 on an outer side of the heat generating layer 22 and the heat insulating layer 23 on an inner side of the heat generating layer 22 store a certain amount of heat, and thus a temperature drop is suppressed, thereby allowing fixing to be performed at a constant temperature.

Furthermore, in this embodiment, the excitation unit composed of the excitation coil 36 and the rear core 37 is placed outside the heating roller 21, and thus a temperature rise in the excitation unit or the like, which is caused due to the influence of the temperature of the heat generating part, is suppressed, thereby allowing a stable amount of heat to be generated.

Furthermore, generally, with an increase in process speed, in order to secure a nip length Ln and a nip pressure that are necessary for fixing, it is required that a large pressure be caused between the heating roller 21 and the pressing roller 31. In this embodiment, such a pressure is received by the supporting layer 24 through the heat insulating layer 23 formed of an elastic body. Therefore, the distortion of the supporting layer 24 is suppressed to a relatively small amount, and thus the nip length Ln is made uniform in a width direction, and a wide nip region can be obtained.

As described above, in this embodiment, a heating roller and an image heating device can be provided that achieve a reduction in warm-up time and allow a sufficient nip length and nip pressure to be obtained, thereby attaining an excellent fixing property. Further, the heat generating layer 22 is rotated integrally with the heat insulating layer 23 and the supporting layer 24, and thus the heat generating layer 22 has reduced abrasion and dynamic resistance. Further, meandering of the heat generating layer 22 also is prevented.

(Embodiment I-2)

The description is directed next to an image heating device as a fixing device according to Embodiment I-2 with reference to FIGS. 1, 6 and 9. In Embodiment I-2, like reference characters indicate like members that have the same configurations and perform the same functions as those of the image heating device described with regard to Embodiment I-1, for which duplicate descriptions are omitted. In this embodiment, a pressing roller 31, an excitation coil 36, a rear core 37 and the like have the same configurations as those described with regard to Embodiment I-1.

In an example according to this embodiment, as in Embodiment I-1, a heat generating layer 22 is composed of a first heat generating layer 51 provided on a side of a supporting layer 24 and a second heat generating layer 52 provided on an outer side of the first heat generating layer 51. In the example, as the first heat generating layer 51, a 40-$\mu$m thick endless belt-like material of non-magnetic stainless steel SUS304 that was formed by plastic working was used. Although SUS304 essentially has no magnetism, the plastic working causes magnetism to be generated in SUS304. Further, compared with materials such as SUS430, nickel and the like, SUS304 has superior durability against mechanical deformation as its essential property and thus is suitable for use in an induction heating roller subjected to repeated mechanical deformation. Further, in the example, the second heat generating layer 52 was obtained by plating a surface of the first heat generating layer 51 with copper in a thickness of 5 $\mu$m.

In this embodiment, the supporting layer 24 is formed of a material having a high specific resistance (for example, ceramics). In the example, the supporting layer 24 was formed from alumina (specific resistance: $2\times10^{17}$ Ωm).

Hereinafter, a function of heating the heat generating layer 22 of a heating roller 21 under an eddy current will be described with reference to FIG. 6. As in Embodiment I-1, since the heat generating layer 22 has a thickness smaller than a skin depth, magnetic flux generated by an excitation unit is separated into portions of the magnetic flux (dotted lines D and D') that pass through the heat generating layer 22 and portions of the magnetic flux (dotted lines E and E') that penetrate the heat generating layer 22 and then pass through the supporting layer 24. The supporting layer 24 has a high specific resistance and thus hardly generates heat even when magnetic flux passes through the supporting layer 24. Thus, the supporting layer 24 is prevented from being heated, so that breakage is not caused in bearings or the like.

Furthermore, as shown in FIG. 9, in the case where the supporting layer 24 is formed from alumina with a high specific resistance, particularly, extremely high efficiency is obtained at a frequency in a region of low frequencies in the vicinity of 20 kHz, thereby allowing heating to be performed efficiently without causing a loss.

While being driven to rotate, the fixing device having the above-mentioned configuration was supplied with a power of 800 W at 23 kHz so that warming up was started from room temperature. Monitoring of the output of a temperature detecting sensor 41 showed that the temperature of a surface of the heating roller 21 reached 170 degrees centigrade after a lapse of about 10 seconds from a start of the power supply. Next, when passing paper sheets continuously, the temperature of both end portions (portions of bearings 28 and 28') of the supporting layer 24 became about 35 degrees centigrade.

According to this embodiment, the supporting layer 24 is formed of a material having a high specific resistance and thus hardly is heated under eddy current. Thus, breakage is not caused in the bearings or the like. Further, the heat generating layer 22 can be heated intensively, thereby allowing warm-up time to be reduced further.

(Embodiment 1-3)

Figure 12:
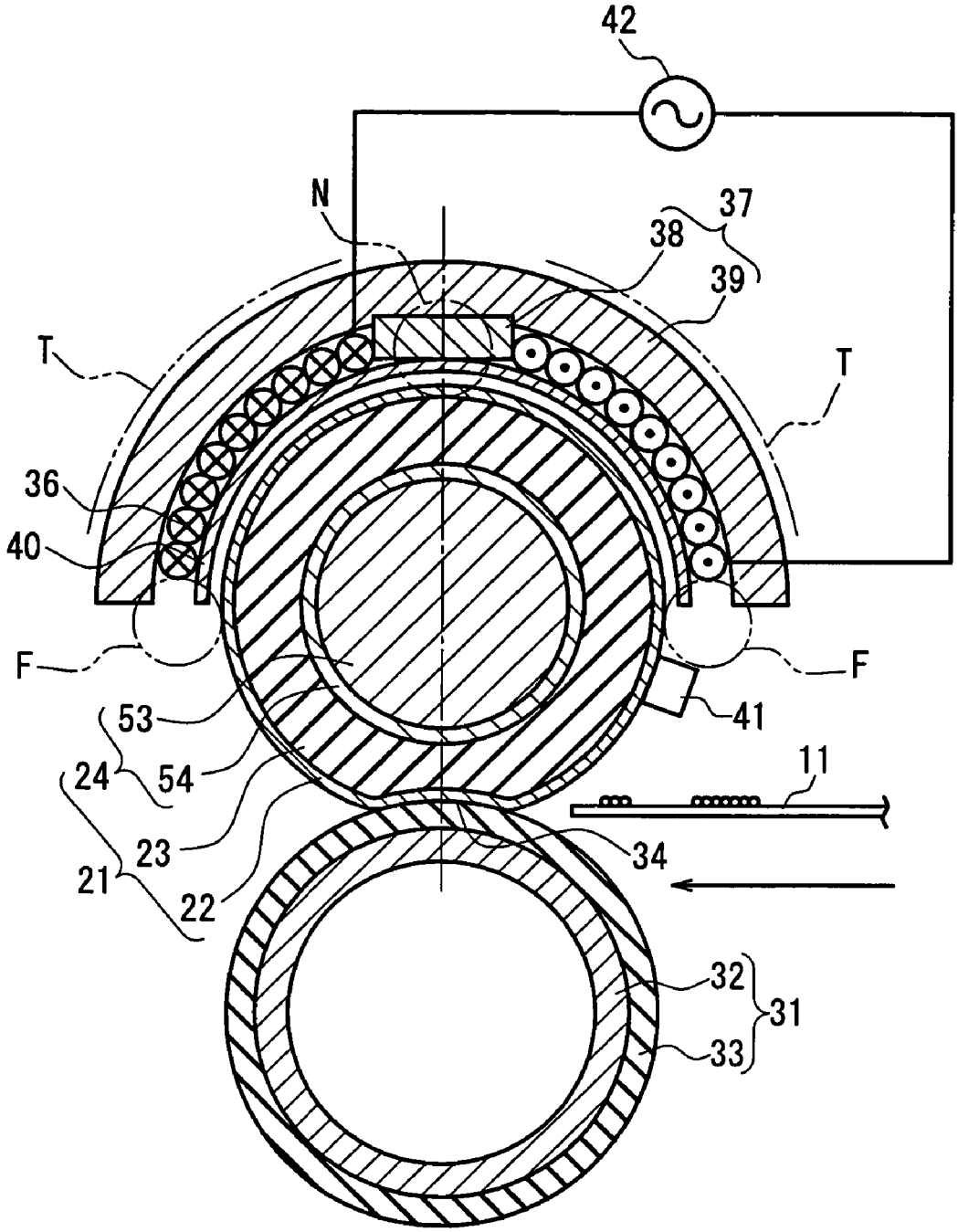
FIG. 12 is a cross sectional view of an image heating device according to Embodiment I-3 of the present invention.
Figure 13:
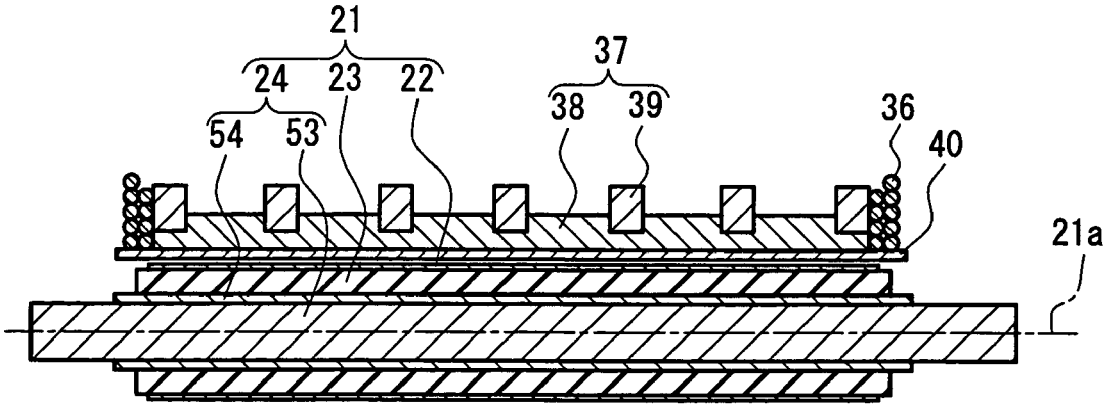
FIG. 13 is a cross sectional view of the image heating device according to Embodiment I-3 of the present invention.

The description is directed next to an image heating device as a fixing device according to Embodiment I-3 with reference to FIGS. 12 and 13. In Embodiment I-3, like reference characters indicate like members that have the same configurations and perform the same functions as those of the image heating device described with regard to Embodiment I-1, for which duplicate descriptions are omitted. In this embodiment, a pressing roller 31, an excitation coil 36, a rear core 37 and the like have the same configurations as those described with regard to Embodiment I-1.

In an example according to this embodiment, as in Embodiment I-1, a heat generating layer 22 is composed of a first heat generating layer 51 provided on a side of a supporting layer 24 and a second heat generating layer 52 provided on an outer side of the first heat generating layer 51. In the example, as the first heat generating layer 51, a 40-$\mu$m thick endless belt-like material of non-magnetic stainless steel SUS304 that was formed by plastic working was used. Although SUS304 essentially has no magnetism, the plastic working causes magnetism to be generated in SUS304. Further, compared with materials such as SUS430, nickel and the like, SUS304 has superior durability against mechanical deformation as its essential property and thus is suitable for use in an induction heating roller subjected to repeated mechanical deformation. Further, in the example, the second heat generating layer 52 was obtained by plating a surface of the first heat generating layer 51 with copper in a thickness of 5 $\mu$m.

In this embodiment, as shown in FIGS. 12 and 13, the supporting layer 24 is composed of a rotary shaft 53 and a shielding layer 54 of a material containing at least an oxide magnetic body, which is formed on a surface of the rotary shaft 53. In the example, the rotary shaft 53 was formed of a non-magnetic material of stainless steel SUS304, and a 1-mm thick layer of ferrite was formed on the surface of the rotary shaft 53 as the shielding layer 54. As shown in FIG. 13, the shielding layer 54 is formed in a direction of a rotation center axis 21*a* of a heating roller 21 in an area wider than an area in which the excitation coil 36 is wound. It is desirable that the shielding layer 54 have a specific resistance of 1 Ωm or higher, and in the example, the shielding layer 54 was set to have a specific resistance of 6.5 Ωm. Further, it is desirable that the shielding layer 54 have a relative magnetic permeability of 1,000 or higher, and in the example, the shielding layer 54 was set to have a relative magnetic permeability of 2,200. The same effect can be attained regardless of whether the thickness of the shielding layer 54 is smaller or larger than the above-mentioned value employed in the example. Further, the shielding layer 54 may be formed of a thin layer of ferrite by a plating method. Further, the shielding layer 54 also may be formed by dispersing ferrite powder in a resin, and the same effect can be attained as long as the shielding layer 54 is formed of a material containing at least an oxide magnetic body.

Figure 14:
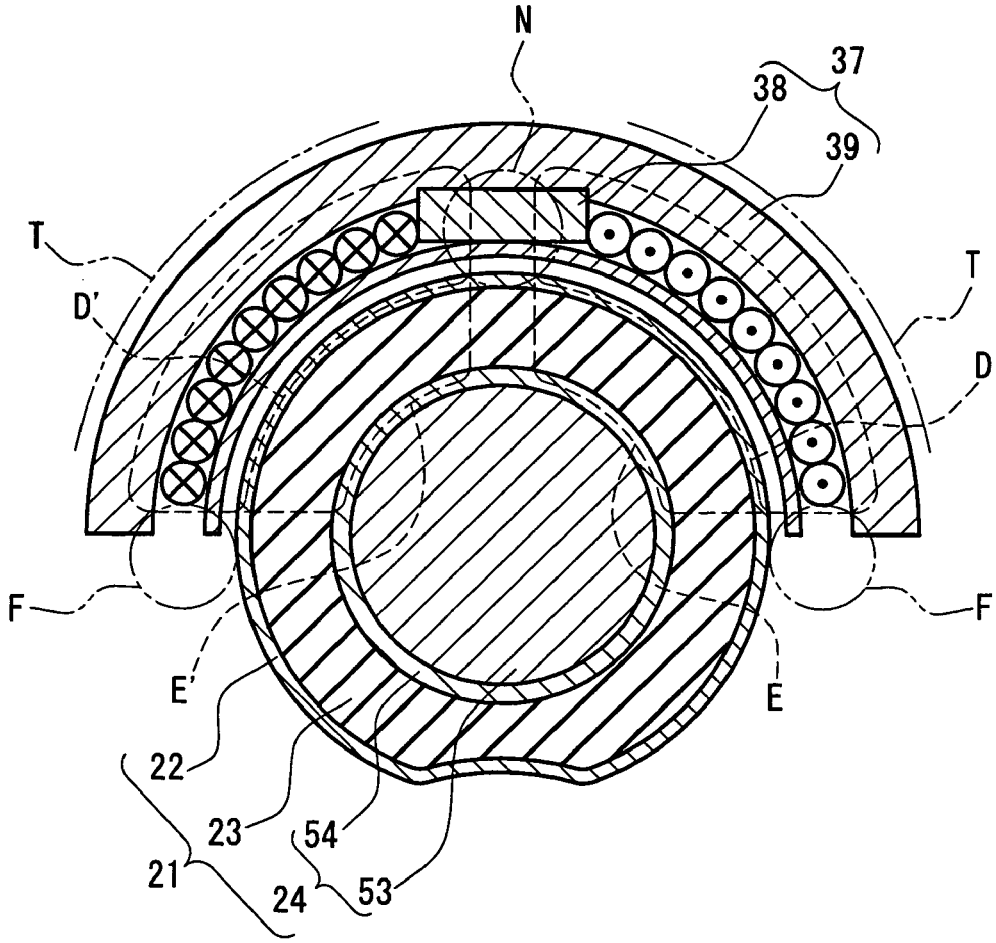
FIG. 14 is a cross sectional view for explaining a mechanism in which an excitation unit causes a heating roller to generate heat by electromagnetic induction in the image heating device according to Embodiment I-3 of the present invention.

Hereinafter, a function of heating the heat generating layer 22 of the heating roller 21 under eddy current will be described with reference to FIG. 14. As in Embodiment I-1, since the heat generating layer 22 has a thickness smaller than a skin depth, magnetic flux generated by an excitation unit is separated into portions of the magnetic flux (dotted lines D and D') that pass through the heat generating layer 22 and portions of the magnetic flux (dotted lines E and E') that penetrate the heat generating layer 22 and then pass through the shielding layer 54. The shielding layer 54 has magnetism, and thus the portions of the magnetic flux are prevented from penetrating the shielding layer 54 and then reaching the rotary shaft 53. Further, the shielding layer 54 has a high specific resistance (6.5 Ωm in the example) and thus hardly generates heat even when magnetic flux passes through the shielding layer 54. Further, the shielding layer 54 is formed in the direction of the rotation center axis 21*a* of the heating roller 21 in the area wider than the area in which the excitation coil 36 is placed. This prevents magnetic flux from entering the rotary shaft 53 from both end portions of the rotary shaft 53, in which the shielding layer 54 is not formed. Thus, the rotary shaft 53 is prevented from being heated, so that no breakage is caused in bearings or the like. Further, the shielding layer 54 has magnetism, and thus magnetic coupling between the shielding layer 54 and the excitation unit is enhanced, thereby allowing larger power to be applied. Thus, heat generation of the heat generating layer 22 attains a sufficient level, and warm-up time can be reduced.

As described above, in the case where the supporting layer 24 is composed of two layers, and the shielding layer 54 formed of a magnetic material having a high specific resistance of, for example, ferrite is formed as a layer closer to the excitation coil 36, compared with the case where the supporting layer 24 is configured as a single layer of stainless steel or aluminum, warm-up time is reduced, and heat generation of the supporting layer 24 also can be suppressed.

While being driven to rotate, the fixing device having the above-mentioned configuration was supplied with a power of 800 W at 25 kHz so that warming up was started from room temperature. Monitoring of the output of a temperature detecting sensor 41 showed that the temperature of a surface of the heating roller 21 reached 170 degrees centigrade after a lapse of about 11 seconds from a start of the power supply. Next, when passing paper sheets continuously, the temperature of both the end portions (portions of bearings 28 and 28') of the rotary shaft 53 became about 50 degrees centigrade.

As described above, according to this embodiment, even in the case where the rotary shaft 53 is formed of a less costly metallic material having high mechanical rigidity, since the shielding layer 54 described above is provided on the surface of the rotary shaft 53, magnetic flux is caused to pass through the shielding layer 54, so that the rotary shaft 53 hardly is heated under eddy current. Thus, breakage is not caused in bearings or the like. Further, the heat generating layer 22 can be heated intensively, thereby allowing warm-up time to be reduced.

In Embodiment I-3, a configuration was shown as an example, in which the supporting layer 24 was composed of the rotary shaft 53 and the shielding layer 54 of a material containing an oxide magnetic body, which was formed on an outer surface of the rotary shaft 53. However, the whole supporting layer 24 may be formed of a material containing an oxide magnetic body. Oxide magnetic bodies have high magnetic permeability, and thus larger power can be applied, thereby allowing warm-up time to be reduced. Further, oxide magnetic bodies have a high specific resistance and thus do not generate heat even when magnetic flux passes through inner portions thereof.

(Embodiment I-4)

Figure 15:
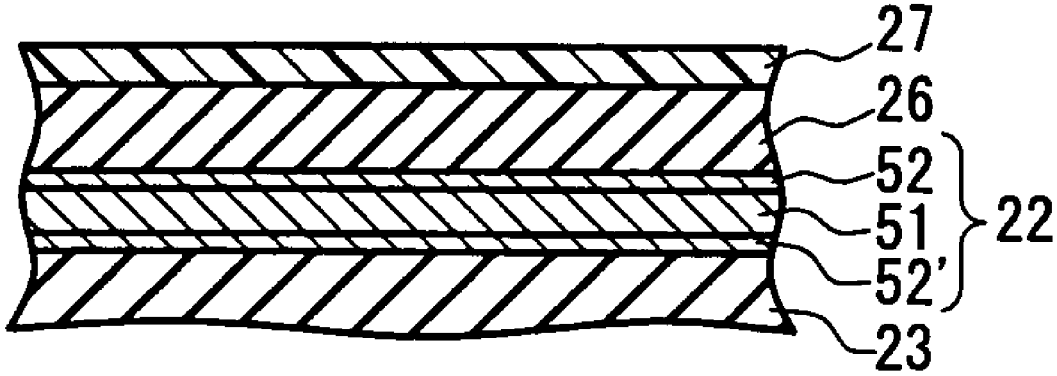
FIG. 15 is a partial cross sectional view of a surface layer portion of a heating roller including a heat generating layer, which is used in an image heating device according to Embodiment I-4 of the present invention.

The description is directed next to an image heating device as a fixing device according to Embodiment I-4 with reference to FIGS. 1 and 15. In Embodiment I-4, like reference characters indicate like members that have the same configurations and perform the same functions as those of the image heating device described with regard to Embodiment I-1, for which duplicate descriptions are omitted. In this embodiment, a pressing roller 31, an excitation coil 36, a rear core 37 and the like have the same configurations as those described with regard to Embodiment I-1.

In this embodiment, as shown in FIG. 15, a heat generating layer 22 is formed by forming second heat generating layers 52 and 52' respectively on both surfaces of a first heat generating layer 51. The first heat generating layer 51 and the second heat generating layers 52 and 52' are formed respectively of the same materials as those of the first heat generating layer 51 and the second heat generating layer 52 described with regard to Embodiment I-1.

Figure 16:
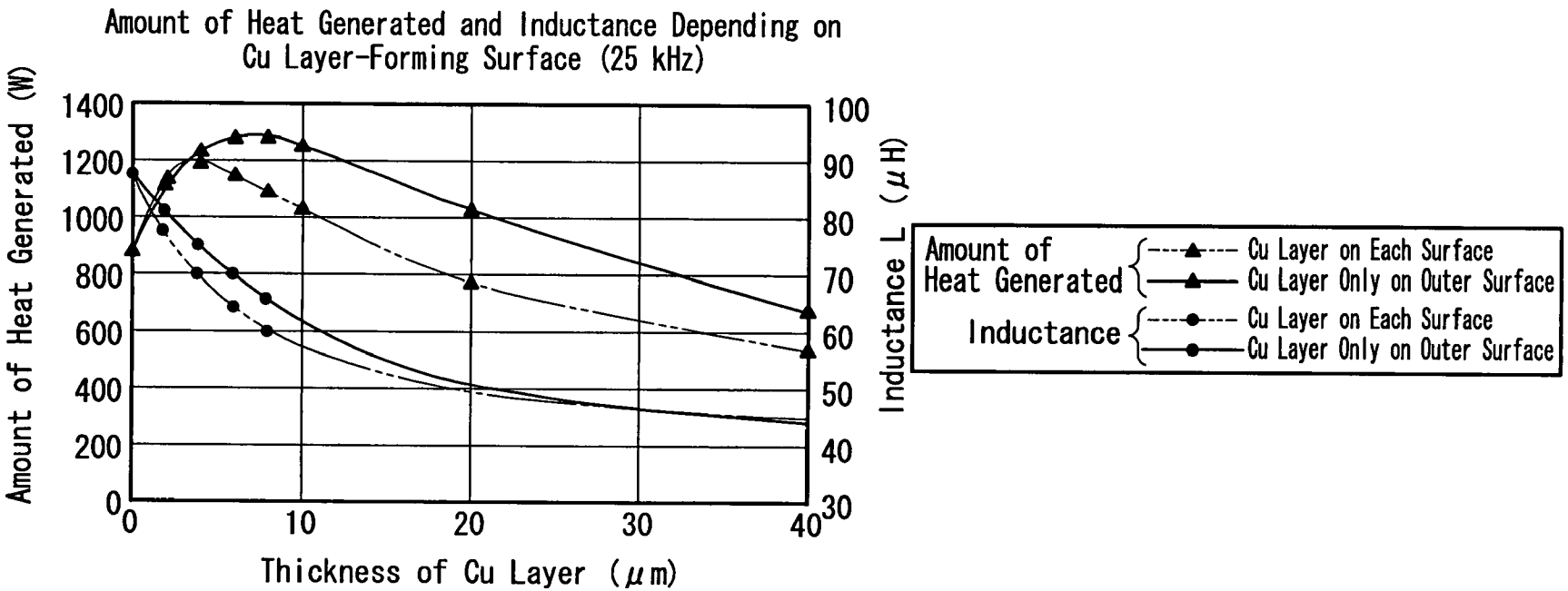
FIG. 16 is a graph showing the results of an analysis of a relationship between both a layer-forming surface and a thickness of a copper plating layer and an amount of heat generated, in an image forming apparatus according to Embodiment I-4 of the present invention.

With respect to the following cases related to the heat generating layer 22, an analysis was made to determine changes in an amount of heat generated and in inductance (L) in the heat generating layer 22 as a whole when a copper plating layer varied in thickness. In one of the cases, the heat generating layer 22 was formed of a 40-μm thick SUS430 layer with a copper plating layer formed on an outer surface thereof (corresponding to Embodiment I-1), and in the other case, the heat generating layer 22 was formed of a 40-μm thick SUS430 layer with a copper plating layer formed on each surface thereof (corresponding to Embodiment I-4). FIG. 16 shows the results of the determination. The results are based on a condition in which an electric current at a constant frequency of 25 kHz is used and an excitation circuit 42 also has a constant current value. As is apparent from these results, as for an amount of heat generated, in the case of applying copper plating to each surface of the SUS430 layer, a maximum amount of heat generated is slightly smaller than in the case of applying copper plating only to the outer surface of the SUS430 layer. However, where the copper plating layer has a thickness in a range of not more than about 15 μm, a larger amount of heat is generated than in the case of the heat generating layer 22 without the copper plating layer (thickness of the copper plating layer=0 μm). Further, as for the inductance L, it is shown that in the case of applying copper plating to each surface of the SUS430 layer, the inductance L is lower than in the case of applying copper plating only to the outer surface of the SUS430 layer. As a result, the generation of magnetic flux is reduced, and thus magnetic flux reaching the supporting layer 24 also is decreased. Thus, heat generation of the supporting layer 24 is reduced, and leakage electromagnetic wave noise also is reduced.

In each of Embodiments I-1 to I-4 described above, a configuration was shown as an example, in which the excitation unit was composed of the saddle-shaped excitation coil 36 and the rear core 37. However, the excitation unit according to the present invention is not limited thereto as long as an alternating magnetic field can be generated. Further, a configuration was shown as an example, in which the pressing unit was formed of the rotatable pressing roller 31. However, the pressing unit according to the present invention is not limited thereto. For example, a pressing guide that is locked in a position while being in contact under pressure with the heating roller 21 also may be used.

[Embodiment II]

Figure 17:
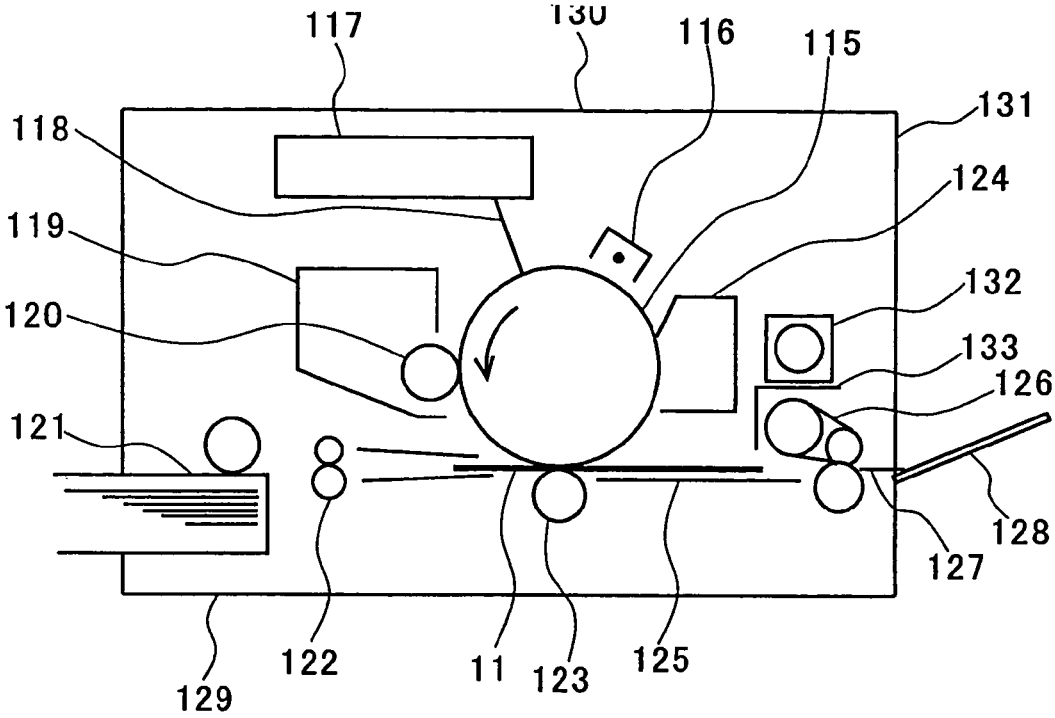
FIG. 17 is a cross sectional view schematically showing a configuration of an image forming apparatus according to Embodiment II of the present invention.

FIG. 17 is a cross sectional view of an example of an image forming apparatus according to the present invention, in which an image heating device is used as a fixing device. An image heating device mounted in an image forming apparatus according to Embodiment II is an electromagnetic induction heating device of the belt heating type. The following description is directed to a configuration and an operation of this device.

In FIG. 17, reference numeral 115 denotes an electrophotographic photoreceptor (hereinafter, referred to as a "photosensitive drum"). The photosensitive drum 115, while being driven to rotate at a predetermined peripheral velocity in a direction indicated by an arrow, has its surface charged uniformly to a negative dark potential V0 by a charger 116. Further, reference numeral 117 denotes a laser beam scanner that outputs a laser beam 118 corresponding to a signal of image information. The charged surface of the photosensitive drum 115 is scanned by and exposed to the laser beam 118. Thus, in an exposed portion of the photosensitive drum 115, an absolute potential value is decreased to a light potential VL, and a static latent image is formed. The latent image is developed with negatively charged toner of a developer 119 and made manifest.

The developer 119 includes a developing roller 120 that is driven to rotate. The developing roller 120 with a thin toner film formed on an outer peripheral face is opposed to the photosensitive drum 115. A developing bias voltage, whose absolute value is lower than the dark potential V0 of the photosensitive drum 115 and higher than the light potential VL, is applied to the developing roller 120.

Meanwhile, a recording material 11 is fed one at a time from a paper feeding part 121 and passed between a pair of resist rollers 122. Then, the recording material 11 is conveyed to a nip part composed of the photosensitive drum 115 and a transferring roller 123, and the timing thereof is appropriate and synchronized with the rotation of the photosensitive drum 115. Toner images on the photosensitive drum 115 are transferred one after another to the recording material 11 by the transferring roller 123 to which a transfer bias voltage is applied. After the recording material 11 is released from the photosensitive drum 115, an outer peripheral face of the photosensitive drum 115 is cleaned by removing residual materials such as toner remaining after the transferring process by a cleaning device 24 and used repeatedly for successive image formation.

Reference numeral 125 denotes a fixing guide that guides the recording material 11 on which the image is transferred to a fixing device 126. The recording material 11 is released from the photosensitive drum 115 and conveyed to the fixing device 126 where fixing of the transferred toner image is performed. Further, reference numeral 127 denotes a paper ejecting guide that guides the recording material 11, which has passed through the fixing device 126, to the exterior of the apparatus. The fixing guide 125 and the paper ejecting guide 127 that guide the recording material 11 are formed from a resin such as ABS or a non-magnetic metallic material such as aluminum. The recording material 11 on which the image is fixed by the fixing process is ejected to a paper ejecting tray 128.

Reference numerals 129, 130, and 131 denote a bottom plate of a main body of the apparatus, a top plate of the main body, and a body chassis, which constitute a unit determining the strength of the main body of the apparatus. These strength members are formed of a material using a magnetic material of steel as a base material and plated with zinc.

Reference numeral 132 denotes a cooling fan that generates airflow in the apparatus. Further, reference numeral 133 denotes a coil cover formed of a non-magnetic material such as aluminum, which is configured so as to cover an excitation coil 36 and a rear core 37 that constitute the fixing device 126.

The above-mentioned fixing device 126 includes a heating belt including a heat generating layer that generates heat by electromagnetic induction, an excitation unit that heats the heat generating layer by external excitation, a supporting roller that makes contact internally with and rotatably supports the heating belt, and a pressing unit that makes contact externally with the heating belt to form a nip part. In the fixing device 126, the recording material 11 carrying an image is passed through the nip part so that the image is fixed thermally.

The heat generating layer of the heating belt is composed of at least two layers that are a first heat generating layer formed of a magnetic material and a second heat generating layer formed of a non-magnetic material. The first heat generating layer has a specific resistance higher than a specific resistance of the second heat generating layer and a thickness larger than a thickness of the second heat generating layer.

According to the heating belt described above, the heat generating layer is composed of two layers, and the second heat generating layer is formed of a non-magnetic material. Further, the second heat generating layer has a specific resistance lower than a specific resistance of the first heat generating layer and a thickness smaller than a thickness of the first heat generating layer. Therefore, the second heat generating layer is increased in skin resistance without using a higher driving frequency for an excitation circuit. This allows the second heat generating layer to function effectively as a heat generating part that generates heat by electromagnetic induction. Thus, compared with the case where the heat generating layer is formed only of a single layer of a magnetic material, an increased amount of heat is generated, and heat generation efficiency also is increased, thereby allowing warm-up time to be reduced.

Furthermore, the heat generating layer described above is provided, and thus the heat generating layer is heated intensively. As a result, heat generation of the supporting roller is reduced, thereby allowing the prevention of breakage of, for example, bearings supporting the supporting roller.

Furthermore, it is not required that an electric current at a higher frequency be used to generate an excitation magnetic field, thereby preventing an increase in the occurrence of a switching loss in the excitation circuit. Further, a cost increase of the excitation circuit and an increase in leaking electromagnetic wave noise also are prevented.

Furthermore, the heat generating layer can be reduced in thickness, and thus stress generated due to the deformation of the heat generating layer at the nip part is decreased in proportion to a decrease in the thickness of the heat generating layer. This allows the heat generating layer to have increased durability.

Moreover, the excitation unit can be placed outside the heating belt, and thus an excitation coil or the like that constitutes the excitation unit is prevented from being subjected to a high temperature, thereby allowing stable heating to be performed.

Herein, a magnetic material as a material of the first heat generating layer refers to a ferromagnet, possible examples of which include iron, Permalloy, chromium, cobalt, nickel, ferritic stainless steel (SUS430), martensitic stainless steel (SUS416) and the like. Further, a non-magnetic material as a material of the second heat generating layer refers to a paramagnet and a diamagnet, possible examples of which include aluminum, gold, silver, copper, brass, phosphor bronze, titanium and the like.

Furthermore, an image heating device according to the present invention that can be used as the above-mentioned fixing device 126 includes the above-mentioned heating belt according to the present invention, an excitation unit that heats the heat generating layer by external excitation, a supporting roller that makes contact internally with and rotatably supports the heating belt, and a pressing unit that makes contact externally with the heating belt to form a nip part. In the image heating device, the recording material 11 carrying an image is passed through the nip part so that the image is fixed thermally.

According to this configuration, an image heating device can be provided that allows the heating belt to be heated rapidly without causing breakage of a bearing part of the supporting roller and achieves a reduction in leaking electromagnetic wave noise.

Moreover, an image forming apparatus according to the present invention includes an image forming unit in which an unfixed image is formed on a recording material and carried by the recording material and an image heating device that thermally fixes the unfixed image on the recording material. In the image forming apparatus, the image heating device is the above-mentioned image heating device according to the present invention.

According to this configuration, an image forming apparatus can be obtained that achieves a reduction in warm-up time and an excellent quality of a fixed image.

Hereinafter, an embodiment of an image heating device according to the present invention that is used as the above-mentioned fixing device 126 will be described in detail by way of specific examples (examples).

(Embodiment II-1)

Figure 18:
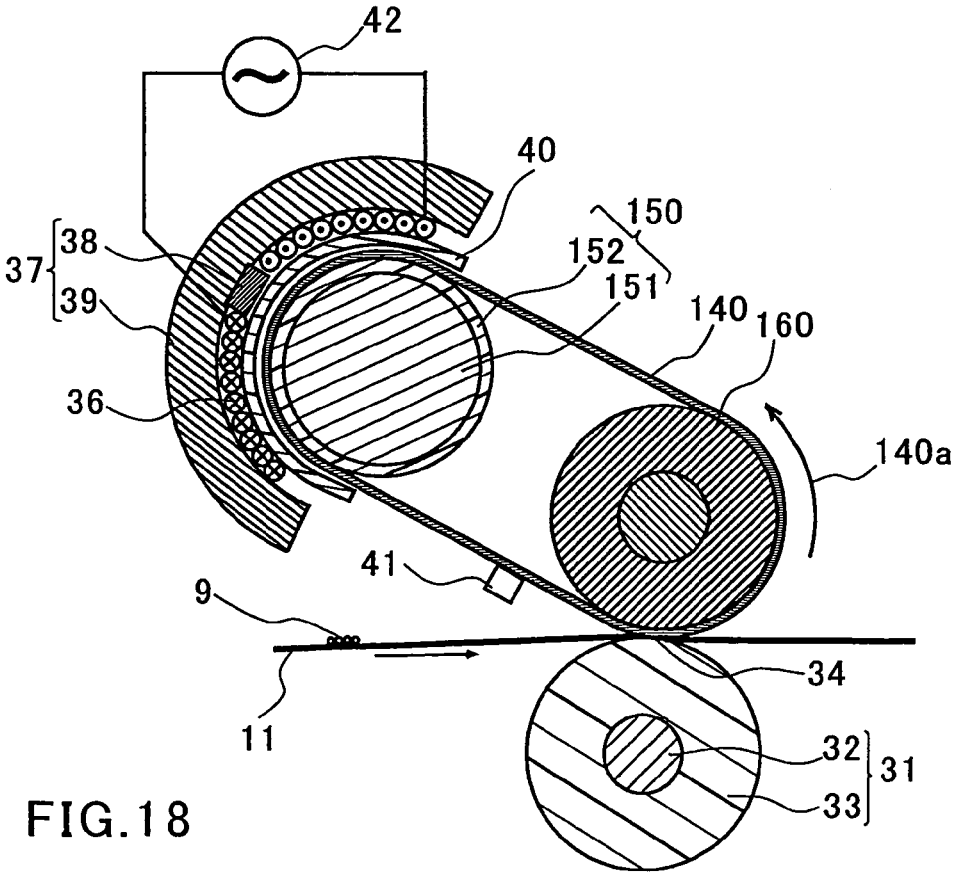
FIG. 18 is a cross sectional view of an image heating device according to Embodiment II-1 of the present invention.

FIG. 18 is a cross sectional view of an image heating device as a fixing device according to Embodiment II-1 of the present invention, which is used in the above-mentioned image forming apparatus shown in FIG. 17. In this embodiment, like reference characters indicate like members that have the same configurations and perform the same functions as those of the image heating device described with regard to Embodiment I-1, for which duplicate descriptions are omitted. In this embodiment, an excitation unit including an excitation coil 36 and a rear core 37, a heat insulating member 40 and a pressing roller 31 have the same configurations as those described with regard to Embodiment I-1.

In FIG. 18, a thin heating belt 140 is an endless belt including a first heat generating layer, a second heat generating layer, an elastic layer, and a mold releasing layer, which are provided outwardly in this order.

The first heat generating layer is formed of a magnetic material of, preferably, a magnetic metal. In an example, as the first heat generating layer, a thin endless belt-like material of 40 $\mu$m thickness that is formed from magnetic stainless steel SUS430 (specific resistance: $6\times10^{-7}$ Ωm) was used. A material of the first heat generating layer is not limited to SUS430, and metals such as nickel, iron, chromium and the like and alloys of these metals also may be used.

The second heat generating layer is formed of a non-magnetic material and has a specific resistance lower than a specific resistance of the first heat generating layer and a thickness smaller than a thickness of the first heat generating layer. In the example, the second heat generating layer was formed by plating a surface of the first heat generating layer with copper (specific resistance: $1.7\times10^{-8}$ Ωm) in a thickness of 5 $\mu$m. A material of the second heat generating layer is not limited to copper and also may be silver, aluminum or the like. A method of forming the second heat generating layer is not limited to plating, and the second heat generating layer may be formed also by metalizing or the like.

The elastic layer is provided so as to improve adhesion to a recording material 11. In the example, the elastic layer was formed of a silicone rubber layer having a thickness of 200 $\mu$m and a hardness of 20 degrees (JIS-A). Although a configuration without the elastic layer poses no problem, it is desirable to provide the elastic layer in the case of obtaining a color image. The thickness of the elastic layer is not limited to 200 $\mu$m, and it is desirable to set the thickness to be in a range of 50 $\mu$m to 500 $\mu$m. In the case where the elastic layer has a thickness larger than thicknesses in the above-mentioned range, the thermal capacity becomes too large, thereby requiring a longer warm-up time. In the case where the elastic layer has a thickness smaller than thicknesses in the above-mentioned range, the effect of providing adhesion to the recording material 11 no longer is exerted. A material of the elastic layer is not limited to silicone rubber, and other types of heat-resistant rubber and resin also may be used.

The mold releasing layer is formed from a fluorocarbon resin such as PTFE (polytetrafluoroethylene), PFA (tetrafluoroethylene-perfluoroalkylvinyl ether copolymer), FEP (tetrafluoroethylene hexafluoropropylene copolymer) or the like. In the example, the mold releasing layer was formed of a fluorocarbon resin layer having a thickness of 30 $\mu$m.

Reference numerals 150 and 160 denote a supporting roller of 20 mm in diameter and a fixing roller of 20 mm in diameter having low thermal conductivity, respectively. A surface of the fixing roller 160 is coated with silicone rubber that is an elastic foam body having a low hardness (ASKER-C45 degrees). The heating belt 140 is suspended with a predetermined tensile force between the supporting roller 150 and the fixing roller 160. The heating belt 140 is allowed to rotate in a direction indicated by an arrow 140*a*. Ribs (not shown) for preventing the heating belt 140 from meandering are provided on both ends of the supporting roller 150.

A pressing roller 31 as a pressing member is in contact under pressure with the fixing roller 160 through the heating belt 140, so that a nip part 34 is formed between the heating belt 140 and the pressing roller 31.

The supporting roller 150 is composed of a heat insulating layer 152 and a supporting layer 151, which are provided inwardly in this order. The supporting layer 151 is formed of a material having a high specific resistance. Specifically, the supporting layer 151 has a specific resistance of $1\times10^{-5}$ Ωm or higher. Moreover, it is preferable that the supporting layer 151 has a relative magnetic permeability of 1,000 or higher. In the example, the supporting layer 151 was formed from ferrite that is an oxide magnetic body having a specific resistance of 6.5 Ωm and a relative magnetic permeability of 2,200 and had a diameter of 20 mm. Further, it is desirable that the heat insulating layer 152 be formed of a foamed elastic body having low thermal conductivity and have a hardness of 20 to 55 degrees (ASKER-C). In the example, the insulating layer was formed of a 5-mm thick foam body of silicone rubber and had a hardness of 45 degrees (ASKER-C) and elasticity.

According to this embodiment, alternating magnetic flux from the excitation unit causes an eddy current to be generated in the heat generating layer of the heating belt 140 so as to cause the heat generating layer to generate heat by induction heating. The heating belt 140, which has been caused to generate heat, heats the recording material 11 and a toner image 9 formed on the recording material 11 at the nip part 34, so that the toner image 9 is fixed on the recording material 11.

The heat generating layer has the above-mentioned two-layer configuration, and thus the heat generation efficiency is increased, thereby allowing warm-up time to be reduced. Further, the heat generating layer is heated intensively, so that heat generation of the supporting layer 151 is reduced, thereby allowing the prevention of breakage of, for example, bearings supporting the supporting roller 150.

In the example, while being driven to rotate, an image heating device having the above-mentioned configuration was supplied with a power of 800 W at 25 kHz so that warming up was started from room temperature. Monitoring of the output of a temperature detecting sensor 41 showed that the temperature of a surface of the heating belt 140 reached 170 degrees centigrade after a lapse of about 13 seconds from a start of the power supply. No heat was generated in the supporting layer 151 of the supporting roller 150, and thus breakage was not caused in the bearings of the supporting roller 150 or the like.

As the heat generating layer of the heating belt 140 according to this embodiment, the configurations of the heat generating layer 22 of the heating roller 21 described above with regard to Embodiments I-1 to I-4 can be used. According to the configurations, the same effects as those of Embodiments I-1 to I-4 can be attained.

Furthermore, as the supporting layer 151 and the heat insulating layer 152 of the supporting roller 150 according to this embodiment, the configurations of the supporting layer 24 and the heat generating layer 23 of the heating roller 21 described above with regard to Embodiments I-1 to I-4 can be used. According to the configurations, the same effects as those of Embodiments I-1 to I-4 can be attained.

Moreover, this embodiment described a configuration in which the heat generating layer was provided in the heating belt 140, and only the heating belt 140 was caused to generate heat by induction heating. However, the same effect can be attained by a configuration in which both of the heating belt 140 and the supporting roller 150 are caused to generate heat by induction heating. In that case, for example, if the supporting roller 150 is formed of a thin pipe formed from an iron alloy such as carbon steel or the like, both of the heating belt 140 and the supporting roller 150 are caused to generate heat by induction heating. In this case, while warm-up time is increased slightly due to the thermal capacity of the supporting roller 150, the following can be achieved. That is, in the case where the recording materials 11 having a width smaller than a width of the heating belt 140 are passed continuously, heat is removed from only a portion of the heating belt 140 by the recording materials 11, thereby causing temperature variations in a width direction of the heating belt 140. Such temperature variations are reduced by heat transmission in the width direction through the supporting roller 150.

(Embodiment II-2)

An image heating device according to Embodiment II-2 of the present invention that is used as the fixing device 126 of the image forming apparatus shown in FIG. 17 will be described in detail by way of an example.

Figure 19:
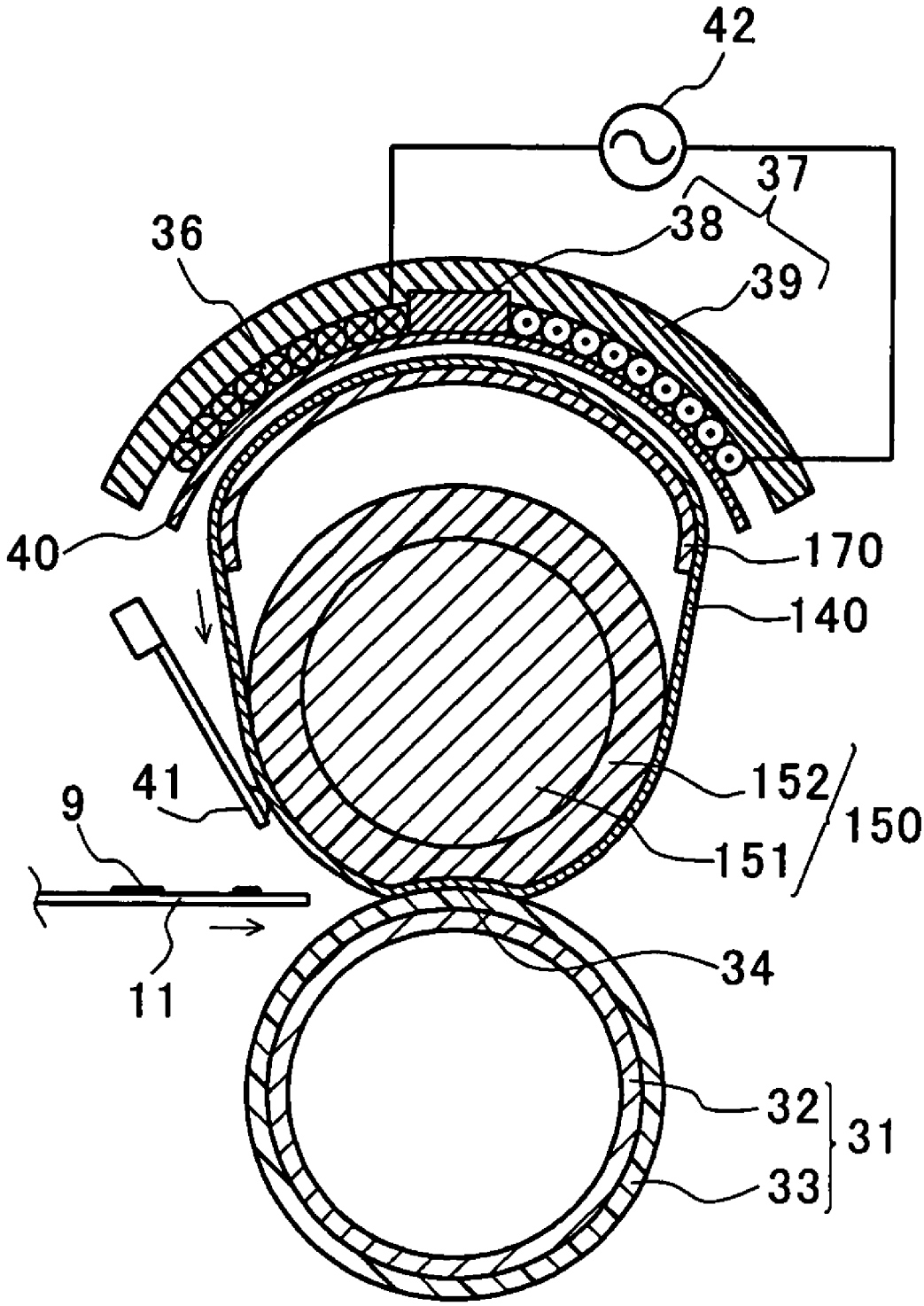
FIG. 19 is a cross sectional view of an image heating device according to Embodiment II-2 of the present invention.
Figure 20:
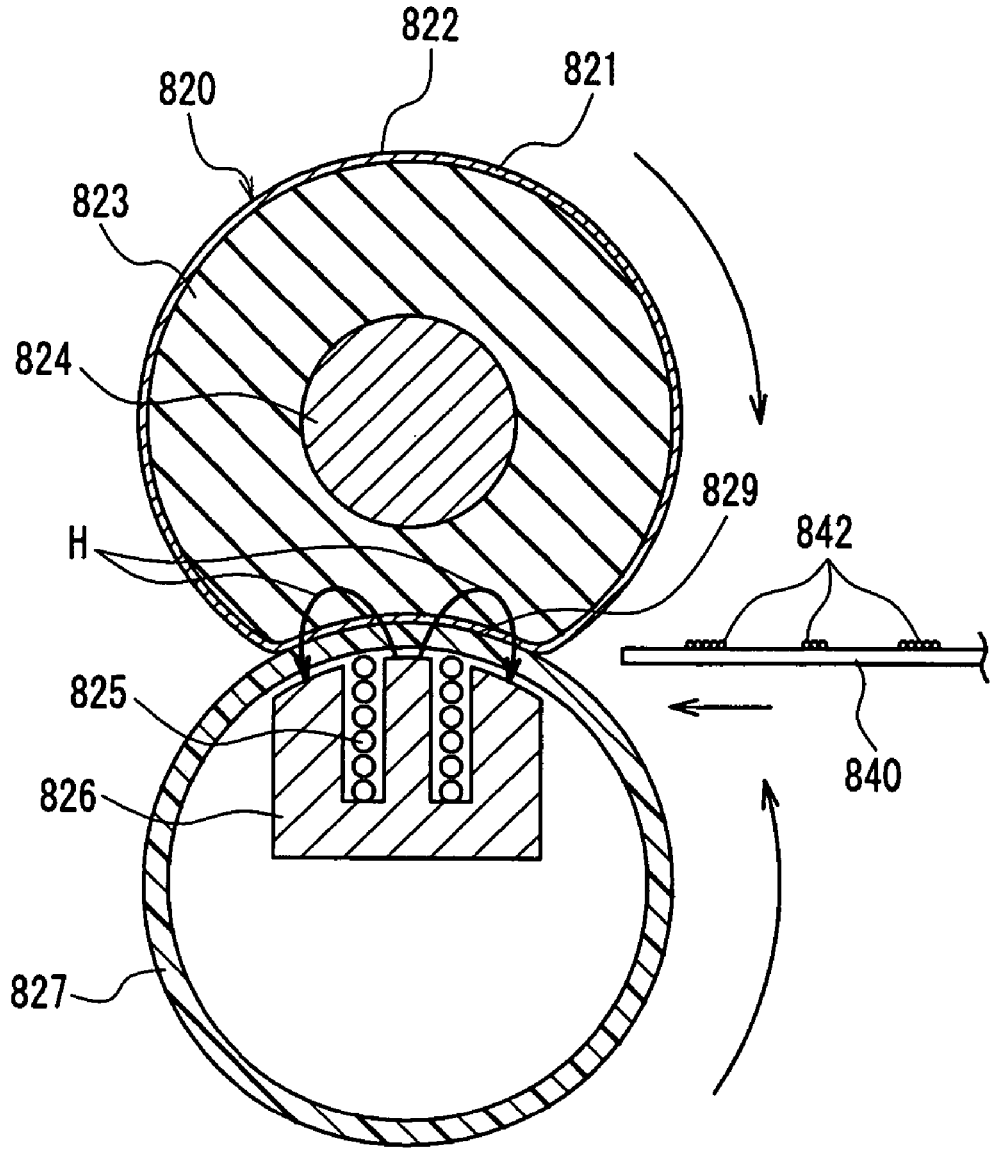
FIG. 20 is a cross sectional view schematically showing a configuration of a conventional image heating device including a heating roller that is heated by electromagnetic induction.
Figure 21:
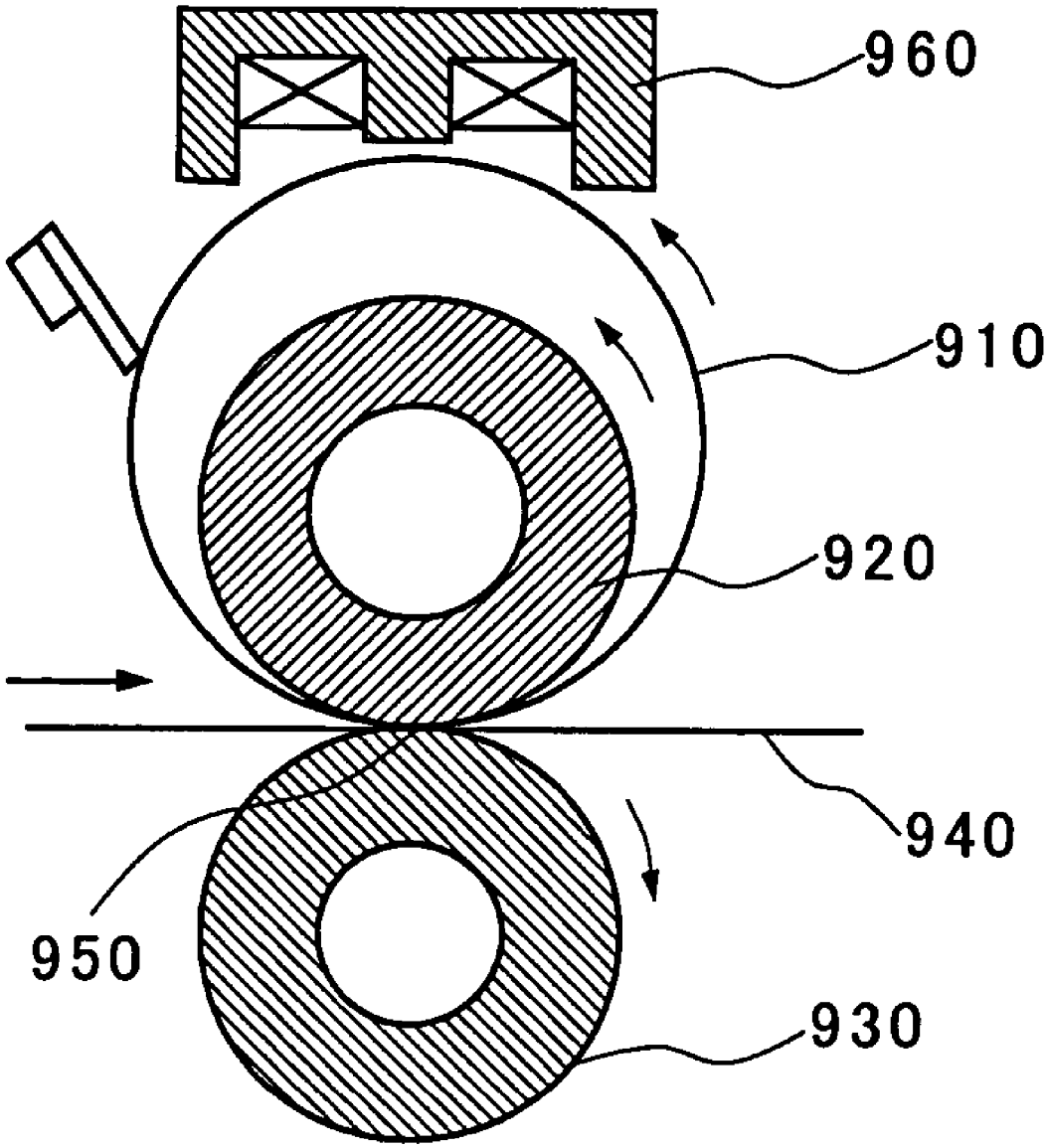
FIG. 21 is a cross sectional view schematically showing a configuration of a conventional image heating device including a heating belt that is heated by electromagnetic induction.

FIG. 19 is cross sectional view of a fixing device as the image heating device according to Embodiment II-2. In this embodiment, like reference characters indicate like members that have the same configurations and perform the same functions as those of the image heating device described with regard to Embodiment I-1, for which duplicate descriptions are omitted. In this embodiment, an excitation unit including an excitation coil 36 and a rear core 37, a heat insulating member 40 and a pressing roller 31 have the same configurations as those described with regard to Embodiment I-1. Further, a heating belt 140 and a supporting roller 150 are the same as those described with regard to Embodiment II-1.

This embodiment is different from Embodiment II-1 in that the heating belt 140 is suspended rotatably between the supporting roller 150 and a belt guide 170, and that the supporting roller 150 is in contact under pressure with the pressing roller 31 through the heating belt 140. The belt guide 170 is formed of, for example, a resin material having an excellent sliding property.

According to Embodiment II-2, as in Embodiment II-1, alternating magnetic flux from the excitation unit causes eddy current to be generated in a heat generating layer of the heating belt 140 so as to cause the heat generating layer to generate heat by induction heating. The heating belt 140, which has been caused to generate heat, heats a recording material 11 and a toner image 9 formed on the recording material 11 at a nip part 34, so that the toner image 9 is fixed on the recording material 11.

The heat generating layer has the above-mentioned two-layer configuration, and thus the heat generation efficiency is increased, thereby allowing warm-up time to be reduced. Further, the heat generating layer is heated intensively, so that heat generation of a supporting layer 151 is reduced, thereby allowing the prevention of breakage of, for example, bearings supporting the supporting roller 150.

In the example, while being driven to rotate, an image heating device having the above-mentioned configuration was supplied with a power of 800 W at 25 kHz so that warming up was started from room temperature. Monitoring of the output of a temperature detecting sensor 41 showed that the temperature of a surface of the heating belt 140 reached 170 degrees centigrade after a lapse of about 11 seconds from a start of the power supply. No heat was generated in the supporting layer 151 of the supporting roller 150, and thus breakage was not caused in the bearings of the supporting roller 150 or the like.

As the heat generating layer of the heating belt 140 according to this embodiment, the configurations of the heat generating layer 22 of the heating roller 21 described above with regard to Embodiments I-1 to I-4 can be used. According to the configurations, the same effects as those of Embodiments I-1 to I-4 can be attained.

Furthermore, as the supporting layer 151 and the heat insulating layer 152 of the supporting roller 150 according to this embodiment, the configurations of the supporting layer 24 and the heat insulating layer 23 of the heating roller 21 described above with regard to Embodiments I-1 to I-4 can be used. According to the configurations, the same effects as those of Embodiments I-1 to I-4 can be attained.

In each of Embodiments II-1 to II-2 described above, a configuration was shown as an example in which the excitation unit was composed of the saddle-shaped excitation coil 36 and the rear core 37. However, the excitation unit according to the present invention is not limited thereto as long as an alternating magnetic field can be generated. Further, a configuration was shown as an example in which the pressing unit was formed of the rotatable pressing roller 31. However, the pressing unit according to the present invention is not limited thereto. For example, a pressing guide that is locked in a position while being in contact under pressure with the heating belt 140 also may be used.

The embodiments disclosed in this application are intended to illustrate the technical aspects of the invention and not to limit the invention thereto. The invention may be embodied in other forms without departing from the spirit and the scope of the invention as indicated by the appended claims and is to be broadly construed.

The invention is claimed:

1. A heating roller that is a roller-shaped heating roller comprising a heat generating layer that generates heat by electromagnetic induction, a heat insulating layer, and a supporting layer, which are provided inwardly in this order, wherein the heat generating layer is composed of at least two layers that are a first heat generating layer formed of a magnetic material and a second heat generating layer formed of a non-magnetic material, the first heat generating layer has a specific resistance higher than a specific resistance of the second heat generating layer, the first heat generating layer has a thickness larger than a thickness of the second heat generating layer the second heat generating layer is disposed on an outer side of the first heat generating layer, and the second heat generating layer has a thickness of 2 to 20 $\mu$m.

2. The heating roller according to claim 1, wherein the second heat generating layer further is disposed on an inner side of the first heat generating layer.

3. The heating roller according to claim 1, wherein the first heat generating layer is formed of a material having a specific resistance of $9\times10^{-8}$ Ωm or higher, and the second heat generating layer is formed of a material having a specific resistance of $3\times10^{-}$Ωm or lower.

4. The heating roller according to claim 1, wherein the first heat generating layer has a thickness of 10 to 100 $\mu$m.

5. The heating roller according to claim 1, wherein the first heat generating layer is formed of a magnetic material of stainless steel, and the second heat generating layer is formed from copper.

6. The heating roller according to claim 1, wherein the supporting layer is formed from a non-magnetic metal.

7. The heating roller according to claim 1, wherein the supporting layer is formed of a material having a specific resistance of 1 Ωm or higher.

8. The heating roller according to claim 1, wherein the supporting layer is formed from ceramics.

9. The heating roller according to claim 1, wherein the supporting layer is formed of a material containing at least an oxide magnetic body.

10. The heating roller according to claim 1, wherein the supporting layer is composed of a rotary shaft and a shielding layer formed on a surface of the rotary shaft, and the shielding layer is formed of a material containing at least an oxide magnetic body.

11. The heating roller according to claim 10, wherein the rotary shaft is formed from a non-magnetic metal.

12. An image heating device, comprising:

a heating roller as claimed in claim 1;

an excitation unit that heats the heat generating layer by external excitation; and a pressing unit that makes contact under pressure with the heating roller to form a nip part, wherein a recording material carrying an image is passed through the nip part so that the image is fixed thermally.

13. The image heating device according to claim 12, wherein the excitation unit has a driving frequency of 20 kHz to 50 kHz.

14. A heating belt comprising a heat generating layer that generates heat by electromagnetic induction, wherein the heat generating layer is composed of at least two layers that are a first heat generating layer formed of a magnetic material and a second heat generating layer formed of a non-magnetic material, the first heat generating layer has a specific resistance higher than a specific resistance of the second heat generating layer, the first heat generating layer has a thickness larger than a thickness of the second heat generating layer, and the second heat generating layer has a thickness of 2 to 20 $\mu$m.

15. An image heating device, comprising:

a heating belt as claimed in claim 14;

an excitation unit that heats the heat generating layer by external excitation;

a supporting roller that makes contact internally with and rotatably supports the heating belt; and a pressing unit that makes contact externally with the heating belt to form a nip part, wherein a recording material carrying an image is passed through the nip part so that the image is fixed thermally, and the second heat generating layer is disposed between the first heat generating layer and the excitation unit.

16. An image forming apparatus, comprising:

an image forming unit in which an unfixed image is formed on a recording material and carried by the recording material; and an image heating device that thermally fixes the unfixed image on the recording material, wherein the image heating device is an image heating device as claimed in claim 12.

17. An image forming apparatus, comprising:

an image forming unit in which an unfixed image is formed on a recording material and carried by the recording material; and an image heating device that thermally fixes the unfixed image on the recording material, wherein the image heating device is an image heating device as claimed in claim 15.

* * * * *

UNITED STATES PATENT AND TRADEMARK OFFICE

CERTIFICATE OF CORRECTION

PATENT NO. : 7,006,781 B2 
APPLICATION NO. : 10/469267
DATED : February 28, 2006
INVENTOR(S) : Imai et al.

It is certified that error appears in the above-identified patent and that said Letters Patent is hereby corrected as shown below:

Title page, title of the invention (54): "HEATING ROLLER, HEATING BELT, IMAGE HEATING DEVICE, AND IMAGE FORMING DEVICE" should read --HEATING ROLLER, HEATING BELT, IMAGE HEATING DEVICE AND IMAGE FORMING APPARATUS--
Page 2, Foreign Patent Documents: "JP 2001-206814" should read --JP 2000-206814--

Signed and Sealed this

Twenty-first Day of November, 2006

JON W. DUDAS
*Director of the United States Patent and Trademark Office*